US007554535B2

(12) United States Patent
Sasaki

(10) Patent No.: US 7,554,535 B2
(45) Date of Patent: Jun. 30, 2009

(54) DISPLAY APPARATUS, IMAGE DISPLAY SYSTEM, AND TERMINAL USING THE SAME

(75) Inventor: Daigo Sasaki, Tokyo (JP)

(73) Assignee: NEC Corporation, Tokyo (JP)

( * ) Notice: Subject to any disclaimer, the term of this patent is extended or adjusted under 35 U.S.C. 154(b) by 817 days.

(21) Appl. No.: 10/491,562

(22) PCT Filed: Oct. 3, 2002

(86) PCT No.: PCT/JP02/10333

§ 371 (c)(1),
(2), (4) Date: Apr. 2, 2004

(87) PCT Pub. No.: WO03/032288

PCT Pub. Date: Apr. 17, 2003

(65) Prior Publication Data

US 2004/0246242 A1 Dec. 9, 2004

(30) Foreign Application Priority Data

Oct. 5, 2001 (JP) ..... 2001-309740

(51) Int. Cl.
*G09G 5/00* (2006.01)

(52) U.S. Cl. ..... 345/206; 345/205; 345/214; 345/211

(58) Field of Classification Search ..... 345/204–215, 345/473, 474, 619, 76, 102–104, 87–89, 345/211, 209, 75.2, 1.1, 98, 77, 691, 699, 345/3.3; 348/441, 452, 459, 157; 250/484.4; 362/561; 382/104, 312, 128, 107
See application file for complete search history.

(56) References Cited

U.S. PATENT DOCUMENTS 4,862,281 A * 8/1989 Sato et al. ..... 358/400
5,097,332 A * 3/1992 Faroudja ..... 348/488
5,493,331 A * 2/1996 Takahashi et al. ..... 348/157
5,569,907 A * 10/1996 Meunier ..... 250/208.1
5,615,027 A * 3/1997 Kuribayashi et al. ..... 349/87
5,734,742 A * 3/1998 Asaeda et al. ..... 382/141
5,750,985 A * 5/1998 Suzuki ..... 250/234

(Continued)

FOREIGN PATENT DOCUMENTS

EP 1 091 341 A2 4/2001

(Continued)

OTHER PUBLICATIONS

Technical Report of IEICE EID 96-4 (Jun. 1996); Jun. 7, 1996.

*Primary Examiner*—Prabodh M Dharia
(74) *Attorney, Agent, or Firm*—Dickstein Shapiro LLP; Dickstein Shapiro LLP

(57) ABSTRACT

In a display, the reduction in brightness which is a problem of the mobile picture improving method in a black reset scheme is reduced to a minimum value and a clear image is displayed.

The display includes a movement amount extracting unit 42 to extract an amount of movement from a time series image signal and a ratio setting unit 43 to set a first period (image gradation display period) to conduct image display on the display element and a second period (black reset period) to display black image thereon according to the extracted amount of movement.

8 Claims, 26 Drawing Sheets

U.S. PATENT DOCUMENTS 5,956,416 A * 9/1999 Tsuruoka et al. ..... 382/128
5,974,360 A * 10/1999 Otsuka et al. ..... 702/3
6,023,537 A * 2/2000 Wada et al. ..... 382/312
6,034,724 A * 3/2000 Nakamura ..... 348/241
6,104,864 A * 8/2000 Kondo et al. ..... 386/117
6,122,412 A * 9/2000 Noguchi et al. ..... 382/312
6,181,300 B1 * 1/2001 Poon et al. ..... 345/698
6,219,113 B1 * 4/2001 Takahara ..... 349/42
6,222,328 B1 * 4/2001 Kikuchi et al. ..... 315/399
6,246,189 B1 * 6/2001 Lee ..... 315/370
6,445,814 B2 * 9/2002 Iijima et al. ..... 382/154
6,618,491 B1 * 9/2003 Abe ..... 382/107
6,636,190 B2 * 10/2003 Hirakata et al. ..... 345/74.1
6,650,362 B1 * 11/2003 Nakamura et al. ..... 348/222.1
6,836,293 B2 * 12/2004 Itoh et al. ..... 348/452
6,903,716 B2 * 6/2005 Kawabe et al. ..... 345/99
6,919,892 B1 * 7/2005 Cheiky et al. ..... 345/473
6,977,385 B2 * 12/2005 Struye et al. ..... 250/484.4
6,982,746 B1 * 1/2006 Kawahara ..... 348/208.99
7,042,431 B1 * 5/2006 Washio et al. ..... 345/98
7,106,350 B2 * 9/2006 Baba et al. ..... 345/691
7,138,974 B2 * 11/2006 Hirakata et al. ..... 345/98
7,227,519 B1 * 6/2007 Kawase et al. ..... 345/77
2002/0003522 A1 * 1/2002 Baba et al. ..... 345/89
2002/0015104 A1 * 2/2002 Itoh et al. ..... 348/459
2002/0036608 A1 * 3/2002 Hirakata et al. ..... 345/87
2002/0057238 A1 5/2002 Nitta et al.
2002/0057241 A1 * 5/2002 Oda et al. ..... 345/87
2002/0063702 A1 * 5/2002 Wada et al. ..... 345/204
2002/0154088 A1 10/2002 Nishimura
2003/0138133 A1 * 7/2003 Nagaoka et al. ..... 382/104
2003/0210339 A1 * 11/2003 Terasawa et al. ..... 348/231.99
2004/0051692 A1 * 3/2004 Hirakata et al. ..... 345/102
2004/0252097 A1 * 12/2004 Kaneki et al. ..... 345/102
2005/0083435 A1 * 4/2005 Itoh et al. ..... 348/441
2007/0052664 A1 * 3/2007 Hirakata et al. ..... 345/102

FOREIGN PATENT DOCUMENTS

JP 2000-122596 4/2000
JP 2000-275604 10/2000
JP 2001-184034 7/2001
JP 2002-156950 5/2002
JP 2002-287700 10/2002
JP 2002-323876 11/2002
WO WO 02/077959 A1 10/2002

* cited by examiner

F I G. 6

| BLACK RESET PERIOD | | AMOUNT OF MOVEMENT | |
|---|---|---|---|
| | | LARGE | SMALL |
| SCREEN BRIGHTNESS | DARK | LONG | INTERMEDIATE |
| | BRIGHT | INTERMEDIATE | SHORT |

HISTOGRAM

COMPARISON BETWEEN BLACK SET PERIODS (a) AND (b)

DISPLAY APPARATUS, IMAGE DISPLAY SYSTEM, AND TERMINAL USING THE SAME

TECHNICAL FIELD

The present invention relates to a display device, an image display system, and a terminal device using the same, and in particular, to improvement of mobile picture quality in a hold type display device continuously emitting light during a frame period.

RELATED ART

Recently, in a liquid crystal display of active matrix type, its size has been increased, an image displayed thereon has become finer, and colors has become purer to obtain a still picture having fully high picture quality. On the other hand, to display a mobile picture, although picture quality is improved by increasing a response speed of liquid crystal, the picture quality thus obtained is not sufficient when compared with that of a cathode ray tube (CRT).

In an operation to display a mobile picture on a hold type display such as a liquid crystal display, when a human eyes track a moving object on a screen, there is obtained an image of the moving object having a blurred periphery (this phenomenon will be referred to as "edge blur" hereinbelow), and hence the mobile picture quality is deteriorated.

An article (Technical Report of IEICE EID96-4 (1996)) describes in detail the cause of deterioration in the mobile picture quality of such a hold type display. The article describes that the cause of deterioration in the mobile picture quality of a hold type display is a principle event associated with 0-order hold (continuously displaying the same gradation during one frame period) by an active element such as a thin film transistor (TFT).

This means that the deterioration in the mobile picture quality cannot be removed only by increasing the response speed of liquid crystal of the liquid crystal display.

To solve the problem described above, several conventional methods have been proposed to improve picture quality by conducting black reset in a frame using liquid crystal having a high-speed response characteristic.

As black reset methods, (1) a method of writing in liquid crystal a reset voltage corresponding to a black output, and (2) a method of conducting black reset by making a backlight blink at timing synchronized with a frame period can be considered.

For the method (1) above, reference is to be made to, for example, the Japanese Patent Laid-Open No. 2000-122596, and for the method (2) above, reference is to be made to, for example, the Japanese Patent Laid-Open No. 2000-275604.

The display described in the Japanese Patent Laid-Open No. 2000-122596 has a configuration including a display screen including a plurality of lines of pixels, and during a period of time in which an image is written in at least one of the pixel lines, a black color is written in other pixel lines to output a black color to liquid crystal to improve the mobile picture quality.

The liquid crystal display described in the Japanese Patent Laid-Open No. 2000-275604 has a configuration in which a lighting device including a plurality of lamps are divided into subareas, and when liquid crystal display sections corresponding to such subareas make a response, a lighting driver starts an operation after a predetermined period of time to turn lamps on in areas of the lighting device corresponding to the sub-areas and turns the lamps off after a predetermined period of time to reduce edge blurs due to the 0-order hold to improve the mobile picture quality.

PROBLEM TO BE SOLVED BY THE INVENTION

However, although the deterioration in the mobile picture quality due to the 0-order hold is suppressed in the conventional black reset insertion scheme, there arises a new problem that the black reset insertion reduces display luminance and contrast.

In the liquid crystal display described in the Japanese Patent Laid-Open No. 2000-275604, although the reduction in the display luminance is suppressed when displaying a still picture by turning all light sources of the lighting device on to display the still picture, a picture becomes darker in an operation to display a mobile picture when compared with a case in which the black reset is not conducted.

Moreover, the deterioration in the mobile picture quality in the hold type display is proportional to a moving speed of the object; however, there has not been a method to improve the mobile picture quality by fully considering the difference in the moving speed.

It is therefore an primary object of the present invention, which has been devised to remove the problem, to provide a display device in which by fully considering the moving speed of the object and the gradation of output signals with respect to the deterioration in the mobile picture quality of the hold type display, the dynamic range is widened by lowering the luminance, particularly, in a black display operation to thereby improve the mobile picture quality.

It is also an object of the present invention is to provide an image display system in which the dynamic range is widened to improve the mobile picture quality in a hold type display.

Moreover, an object of the present invention is to provide a terminal device using the display device and the image display system.

DISCLOSURE OF THE INVENTION

To achieve the objects, there is provided a display device in accordance with the present invention including a display element for sequentially converting a time series image signal into image display light and for displaying an image, movement amount extracting means for extracting an amount of movement from the time series image signal, and ratio setting means for setting a first period to conduct image display on the display element and a second period to display black (image) thereon according to the amount of movement thus extracted.

Moreover, a display device in accordance with the present invention includes movement amount extracting means for extracting an amount of movement from a time series image signal and ratio setting means for setting a ratio between the first period to conduct image display on a display element and the second period to display black image thereon according to the amount of movement thus extracted.

Moreover, a terminal device in accordance with the present invention uses the display device and the image display system.

Additionally, in the display device and the image processing system in accordance with the present invention, by adding a gradation correcting section for input image signals, an image can be displayed according to a feature of brightness of the image.

The display device in accordance with the present invention includes a backlight subdivided into plurality of areas in a scanning direction of the display device, a control circuit capable of controlling on and off of the areas in an independent fashion, a unit to extract features (an amount of movement and a feature of brightness) of an input video signal, and a unit to control on and off of the backlight according to the features. Thanks to the configuration described above, there is obtained a display device having a wide dynamic range and improved mobile picture quality.

Furthermore, the display device in accordance with the present invention includes an optical shutter subdivided into plurality of areas in a scanning direction of the display device, a control circuit capable of controlling transmission and interruption of light for the areas in an independent fashion, a unit to extract features (an amount of movement and a feature of brightness) of an input video signal, and a unit to control the transmission and interruption of light of the optical shutter according to the features. Thanks to the configuration described above, there is obtained a display device having a wide dynamic range and improved mobile picture quality.

Also, the terminal device in accordance with the present invention is characterized by using the display device and the image processing system.

BRIEF DESCRIPTION OF DRAWINGS

FIG. 6 is a diagram schematically showing an example of setting of a black reset period according to brightness of a screen and an amount of movement in an embodiment of the present invention.

Figure 1:
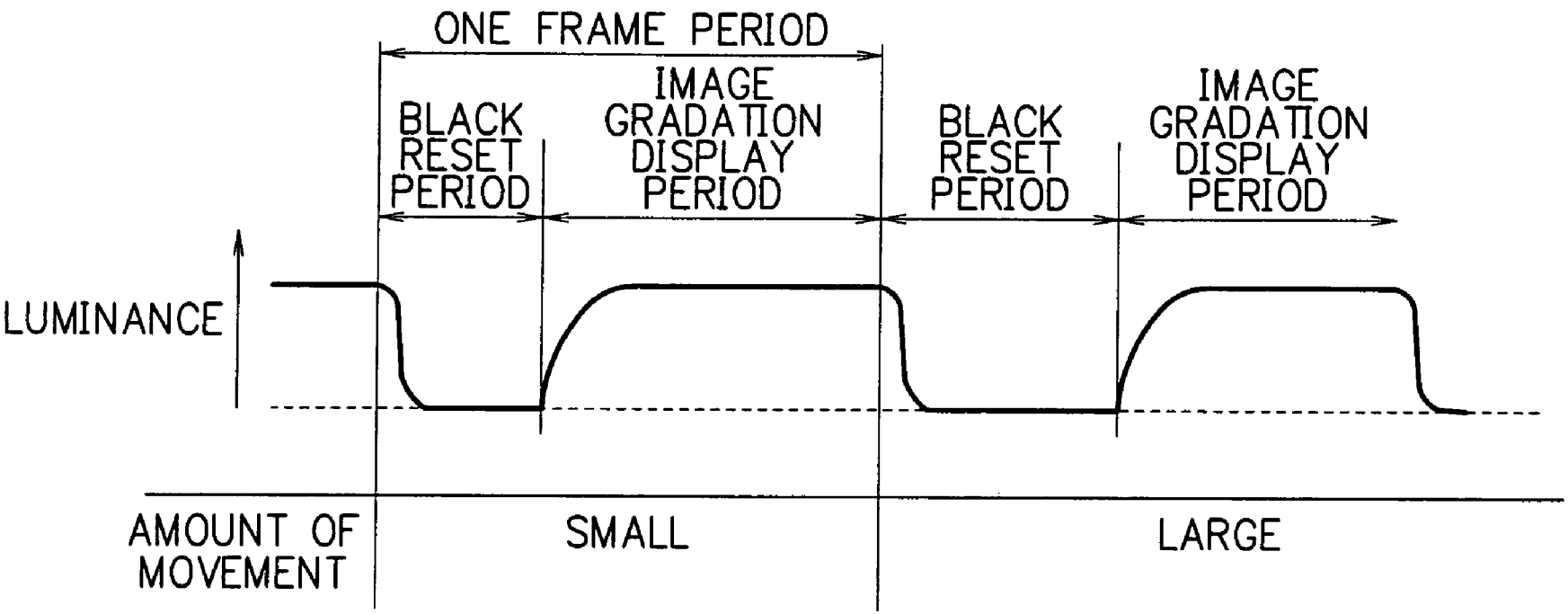
FIG. 1 is a schematic diagram to explain a principle of operation of the present invention showing a time-luminance curve of a liquid crystal display element when a black reset ratio is changed according to an amount of movement.

In this connection, numeral 1 indicates a display panel. Numeral 2 indicates a signal line driver. Numeral 3 denotes a scanning line driver. Numeral 4 indicates a gradation correcting section. Numeral 5 is a control signal generating section. Numeral 6 designates a light driving section. Numeral 7 indicates a lighting section (backlight). Numeral 8 indicates a scanning line. Numeral 9 is a signal line. Numeral 10 indicates a pixel. Numeral 11 denotes a thin film transistor. Numeral 12 indicates an auxiliary capacitor. Numeral 13 designates an image memory. Numeral 14 indicates a decoding circuit section. Numeral 15 designates an optical shutter. Numeral 16 indicates an optical shutter control section. Numeral 20 is a liquid crystal display section. Numeral 21 denotes a liquid crystal panel. Numeral 22 indicates a driving circuit. Numeral 30 designates a variable-length decoding section. Numeral 32 is a dequantizing section. Numeral 33 indicates an inverse DCT section. Numeral 34 denotes a movement compensating circuit. Numeral 35 indicates a movement amount extracting section. Numeral 36 is a black reset period setting section. Numeral 41 indicates an image memory. Numeral 42 designates a movement amount extracting section. Numeral 43 indicates a black reset period setting section. Numeral 50 is a backlight section. Numeral 71 indicates an image memory. Numeral 72 denotes a movement amount extracting section. Numeral 73 indicates a brightness feature extracting section. Numeral 74 is a black reset period setting section. Numeral 81 indicates an image memory. Numeral 82 denotes a movement amount extracting section. Numeral 83 indicates a PGB→Y converting section. Numeral 84 designates a mean luminance calculating section.

Numeral 85 indicates a black reset period setting section. Numeral 101 is an image memory. Numeral 102 denotes a movement amount extracting section. Numeral 103 designates a PGB→Y converting section. Numeral 104 indicates a mean luminance calculating section. Numeral 105 is a black reset period setting section. Numeral 106 indicates a gradation correcting section. Numeral 121 denotes an image memory. Numeral 122 indicates a movement amount extracting section. Numeral 123 indicates a PGB→Y converting section. Numeral 124 is a mean luminance calculating section. Numeral 125 denotes a black reset period setting section. Numeral 126 indicates a gradation correcting section. Numeral 131 is luminance conversion (PGB→Y) histogram processing. Numeral 132 indicates correction 1. Numeral 133 denotes correction 2. Numeral 134 designates black reset width setting. Numeral 141 indicates an optical shutter. Numeral 142 is a light transmitting section. Numeral 143 indicates a light interrupting section. Numeral 144 denotes an optical shutter control section. Numeral 151 indicates an optical shutter. Numeral 152 is an integrator. Numeral 153 indicates a light reflecting section. Numeral 261 denotes an image signal converting section.

BEST MODE FOR CARRYING OUT THE INVENTION

Description will be given of an embodiment of the present invention. First, the principle and operation of the present invention will be described for a hold type display, primarily, a liquid crystal display as an example.

As described above, a liquid crystal display using the black reset scheme to improve mobile picture quality is accompanied by a problem that the maximum luminance and the brightness of the overall screen become lower in proportion to the black reset ratio.

To solve the problem in this situation, there is provided a configuration in accordance with the present invention in which the amount of movement of an image signal is extracted and the black reset ratio is changed according to the amount of movement.

In this connection, "amount of movement" indicates a distance moved by a rigid body during one frame period. This corresponds to a component of magnitude of a movement vector included in a signal encoded according to the moving picture experts group (MPEG) standard. Moreover, when mutually different movements exist for the entire screen, the amount of movement varies between the respective positions. In this case, it is assumed that a representative value thereof indicates the amount of movement.

In accordance with the present invention, the black reset ratio is changed according to the amount of movement because the edge blur has magnitude proportional to the amount of movement of an object and the black reset ratio at least required to improve mobile picture quality varies depending on the amount of movement. This is because a human (a user, an evaluating person) evaluates the mobile picture quality using the width of the edge blur.

In consequence, by setting the black reset ratio to a minimum ratio required to improve the edge blur, the lowing of the maximum luminance and the brightness of the overall screen can be reduced to a minimum value.

FIG. 1 is a diagram to explain an operation principle of the present invention. FIG. 1 schematically shows a time-luminance curve of a liquid crystal element when the black reset ratio is changed according to the amount of movement. As shown in FIG. 1, the liquid crystal element displays an image for each frame, and one frame period includes a black reset period and an image gradation display period. In this situation, an amount of movement is extracted using an image signal. When it is determined as a result that the amount of movement is relatively small, the black reset period can be relatively short, and hence the ratio of the image gradation display period to one frame period is set to a larger value to suppress the reduction in the screen brightness and the maximum luminance. On the other hand, when it is determined that the amount of movement is relatively large, the ratio of the image gradation display period is set to a smaller value to reduce the edge blur width. An example of a specific relationship between the amount of movement and the black reset period will be described below.

Figure 2:
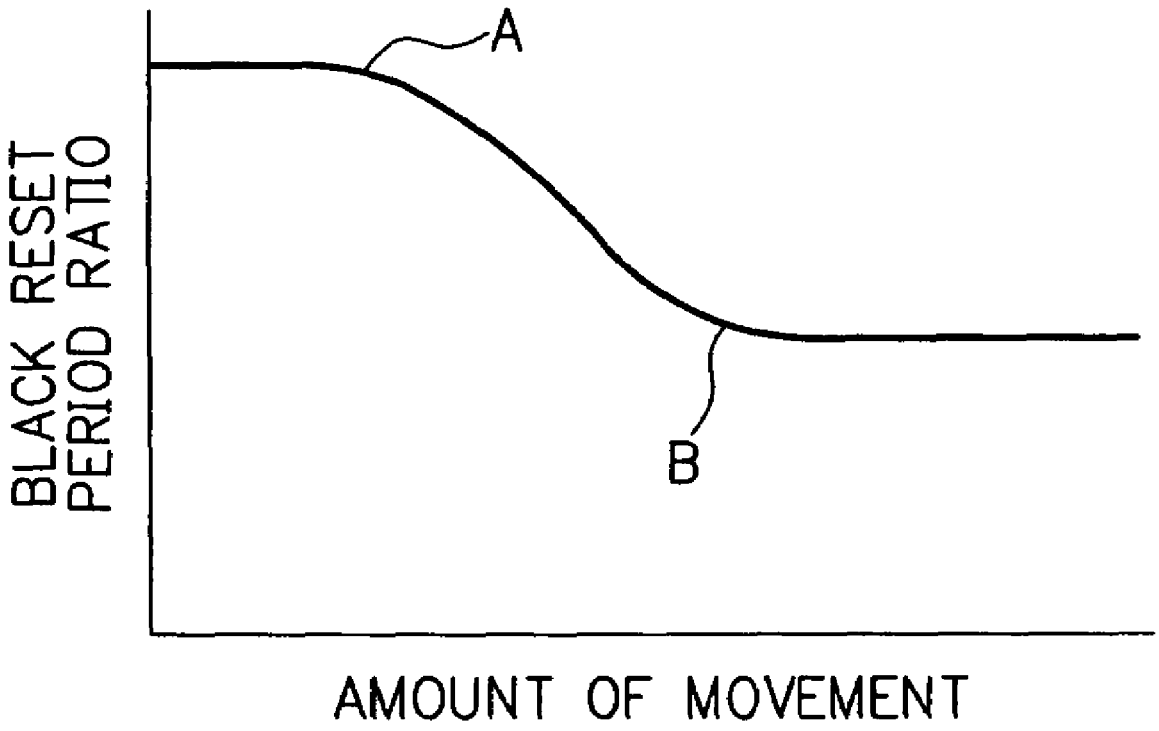
FIG. 2 is a diagram to explain a principle of operation of the present invention showing an example of a relationship between an amount of movement and a black reset period.

FIG. 2 is a diagram showing an example of the relationship between the amount of movement and the black reset period in which the abscissa represents the amount of movement and the ordinate represents the ratio of the black reset period to one frame period. When the amount of movement is too large, the human eyes cannot track the movement and hence the track movement as one principle to cause the edge blur does not take place. Therefore, as shown in FIG. 2, when the amount of movement is equal to or more than a certain amount of movement, the black reset period need only be fixed to suppress the reduction in brightness. Specifically, assuming that one pixel corresponds to one minute of the visual angle of the eyes in the observing environment, the limit speed for occurrence of the track movement is indicated as a value ranging from 20 to 40 pixels per frame in page 854 of "New Edition Sense•Perception Psychology Handbook". Therefore, when the amount of movement is large, the black reset period is fixed. As can be seen from FIG. 2, when the amount of movement is more than 20 pixels/frame (B shown in FIG. 2), the black reset period is set to be equal to 20 pixels/frame. Moreover, since it is considered that the edge blur width is not so problematic until the amount of movement becomes equal to a certain amount, the black reset period is set to be equal to that used when the amount of movement is zero. Since the edge blur is rarely observed in a natural picture when the amount of movement is equal to or less than, for example, three pixels/frame (A shown in FIG. 2), the black reset period is kept unchanged for three pixels/frame or less. The black reset period may be zero in this case; however, if the response time of liquid crystal or the edge blur width is improved by inserting the black reset, a black reset period of about ten percent can be used. Furthermore, for the amount of movement equal to or more than 20 pixels/frame, the black reset period is set to 75% of one frame. It is further favorable that this can be adaptively changed according to sharpness of the video source. That is, when the edge blur width is appropriately reduced in the configuration, the relationship between the amount of movement and the black reset period is not restricted by the relationship shown in FIG. 2, but there may be used another configuration. In accordance with the present invention, the black reset period is relatively enlarged or reduced to improve the edge blur width. That the black reset period is relatively large (or relatively small) is associated with a quantity determined according to human engineering and the quantity need not necessarily conform to the values shown in accordance with the present invention. In other words, in accordance with the present invention, the black reset period can be appropriately increased or decreased to reduce the edge blur width.

The edge blur width changes also according to the response time of liquid crystal in addition to the amount of movement. The response time of liquid crystal is favorably as small as possible, but it is desirable that the response time is at least equal to or less than one frame and is equal to or less than eight milliseconds (ms) if possible.

Moreover, in a panel having a long response time of liquid crystal, by generally elongating the ratio of the black reset period, the edge blur width can be improved as much.

In this case, various methods can be considered to extract the amount of movement depending on types of the image signal inputted to the system. When the input image signal is an encoded digital signal including movement vector information such as the MPEG2 signal, it is possible to extract the amount of movement from the movement vector information.

When the input image signal does not include information regarding the amount of movement such as the RGB signal, it is possible to extract the amount of movement from a plurality of frame images.

To explain in more detail an embodiment of the present invention, description will be given thereof by referring to the drawings.

Figure 3:
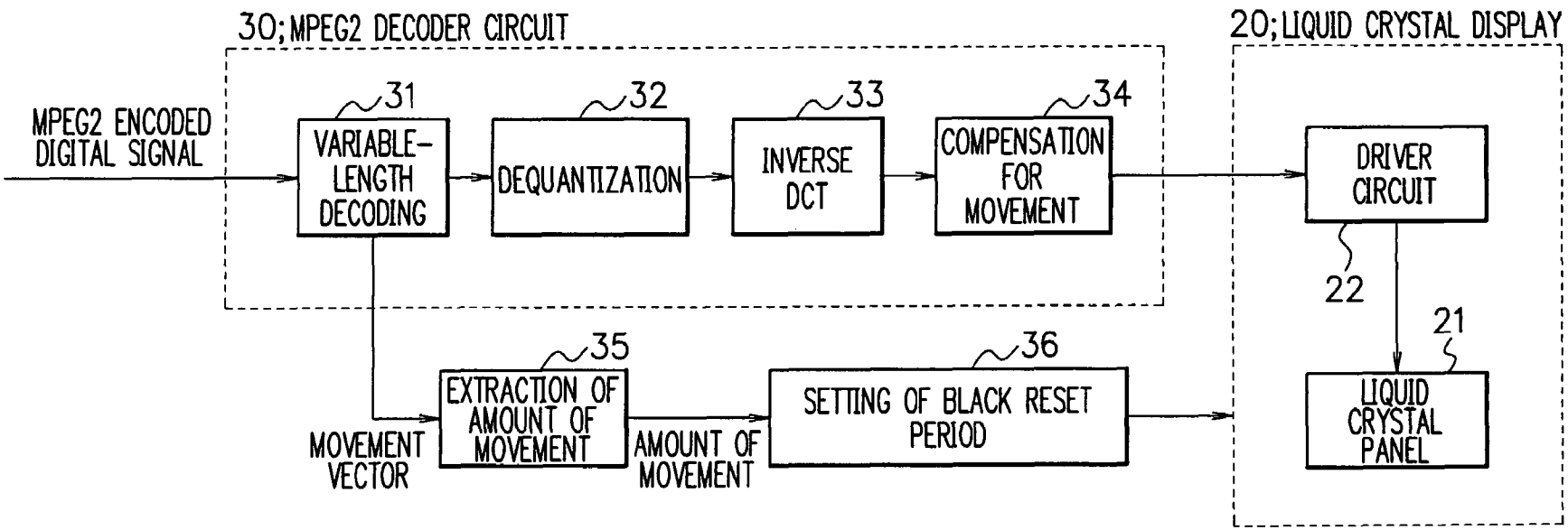
FIG. 3 is a diagram exemplifying a configuration of a first embodiment of the present invention schematically showing a liquid crystal display which conducts extraction of an amount of movement when an MPEG2 encoded digital signal is inputted as an image signal.

FIG. 3 is a diagram showing a configuration of an embodiment in accordance with the present invention. FIG. 3 shows an example of a display in a configuration in which the amount of movement is extracted when an MPEG2 encoded digital signal is inputted as an image signal. Referring to FIG. 3, the MPEG2 signal inputted in the display is decoded by the MPEG2 decoding circuit 30 and is inputted to the liquid crystal display section 20, and a decoded image is displayed on the liquid crystal panel 21. In the operation, the variable-length decoding section 31 of the MPEG2 decoder 30 extracts movement vector information contained in a signal obtained by conducting a variable-length decoding operation for the digital signal encoded according to the MPEG2 standard. The decoding section 31 produces an output signal, and the output signal is dequantized by the dequantizing section 32 and is subjected to an inverse discrete cosine transform in the inverse DCT section 33 and is fed to the movement compensating circuit 34, which produces a video signal to be supplied to the driving circuit 22.

The movement vector information (movement vector) from the variable-length decoding section 31 is inputted to the movement amount extracting section 35, and the section extracts it as an amount of movement; the black reset period setting section 36 sets a black reset period according to the extracted amount of movement and sends it to the liquid crystal display section 20.

Figure 4:
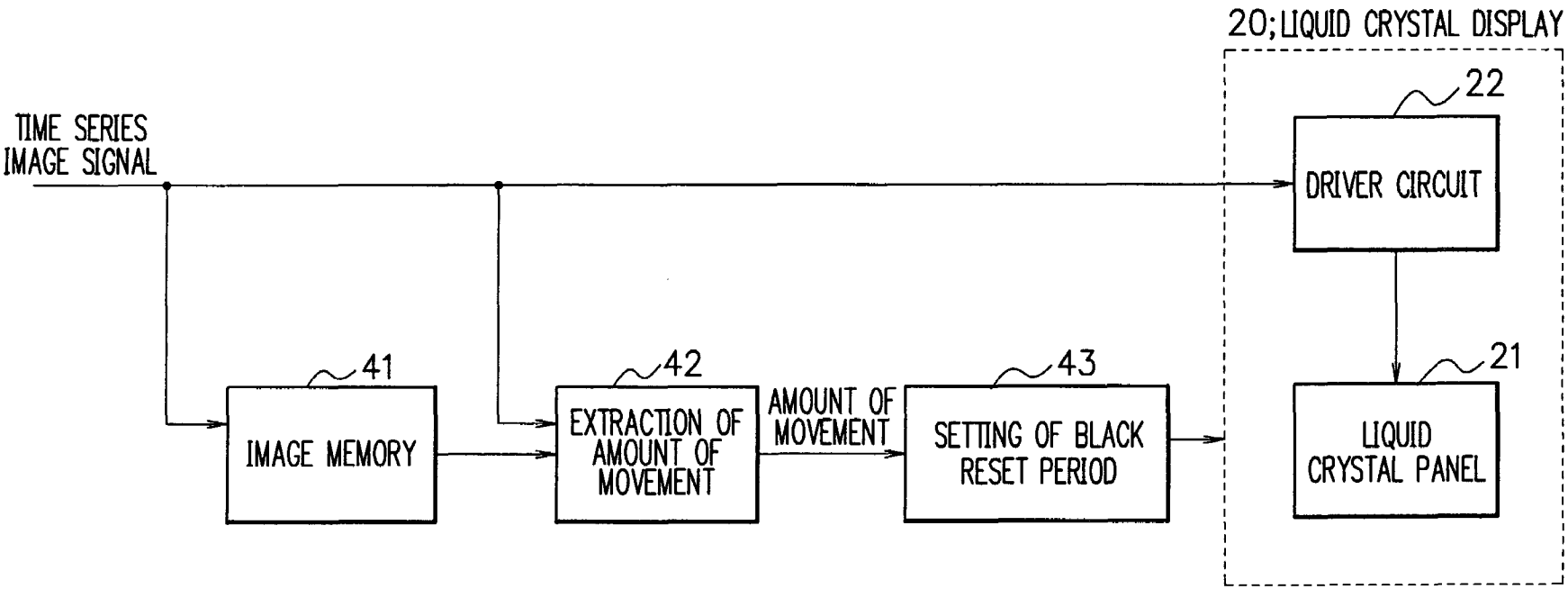
FIG. 4 is a diagram exemplifying a configuration of a second embodiment of the present invention schematically showing a liquid crystal display which conducts extraction of an amount of movement according to an image signal.

FIG. 4 is a diagram showing a configuration of a second embodiment in accordance with the present invention and showing an example of extraction of an amount of movement using an image signal. As shown in FIG. 4, using images of frames preceding a current frame accumulated in the image memory 41 and the image of the current frame, the movement amount extracting section 42 extracts an amount of movement. As a method of detecting the amount of movement, there is used a known method, for example, a block matching method. In the block matching method, a block most similar to a pixel block for which an amount of movement is to be estimated is retrieved from a reference frame (the image stored in the image memory 41 in this case). A representative amount of movement is extracted in the method described above and is fed to the liquid crystal display section 20. According to the amount of movement, the black reset period setting section 43 sets the black reset period to the display section 20.

Incidentally, timing to change the black reset width need not be necessarily set such that the width is changed at an interval of one frame period. It is also possible in the configuration that the black reset width is changed according to the amount of movement, for example, at occurrence of an abrupt change in the amount of movement such a change which takes place when a video scene is greatly changed. In such a configuration, it is possible to suppress in the same video scene a change in the maximum luminance and a variation in the brightness.

Figure 5:
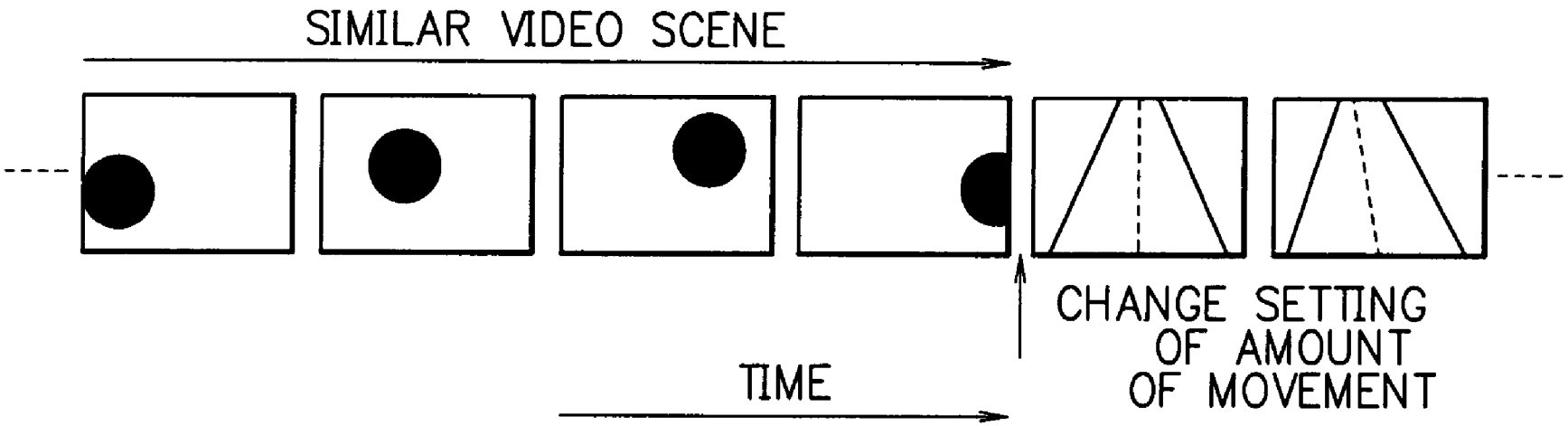
FIG. 5 is a diagram schematically showing an example of timing to change setting of an amount of movement in an embodiment of the present invention.

FIG. 5 is a diagram showing timing to change the movement amount setting. A check is made to determine presence or absence of a change in a video scene for each frame, and when the video scene is greatly changed, the width of the black reset period is set or changed according to the amount of movement.

In this case, the change in the video scene can be detected using a method of determining, for example, a difference between image frames. Or, the change can be detected using a method in which by determining a difference in RGB histograms of an input signal, the change in the video scene is assumed when a sum of difference is equal to or more than a fixed value.

Although the change timing of the black reset is when the video scene is changed, the amount of movement may also be set or changed when the amount of movement is greatly changed.

Description has been given of an operation in which by setting the black reset width according to the amount of movement, the reduction in the maximum luminance and the brightness of the entire screen can be reduced to a minimum value.

Next, description will be given of a fact that a liquid crystal display in which the reduction in the brightness is less annoying can be obtained by setting the black reset period using a feature of brightness of an image in addition to the amount of movement.

The input image signal includes video images of various colors as can be seen from gradation histograms of images such as whitish video images (namely, bright video images) and blackish video images (namely, dark video images). As already described, the edge blur width of a mobile picture is basically proportional to the moving speed of a mobile object although a slight difference exists depending on the brightness. However, even if the mobile picture quality is improved, when the same black reset period is used for a bright video image and a dark video image, the image generally becomes dark.

In this situation, to display a bright video image as bright as possible and to display a dark video image as a darker video image, it is desirable to change the black reset period according to the brightness.

This is comprehensively shown in FIG. 6.

(1) When the amount of movement is large and the screen brightness is low, the black reset period is set to a large value.

(2) When the amount of movement is large and the screen brightness is high, the black reset period is set to an intermediate value.

(3) When the amount of movement is small and the screen brightness is low, the black reset period is set to an intermediate value.

(4) When the amount of movement is small and the screen brightness is high, the black reset period is set to a small value.

In accordance with the present invention, by setting the black reset period using a decision table shown in FIG. 6 according to a relationship between the amount of movement and the screen brightness, the mobile picture quality is improved and there can be obtained a clear image according to a video scene and an image having a wide dynamic range.

Figure 7:
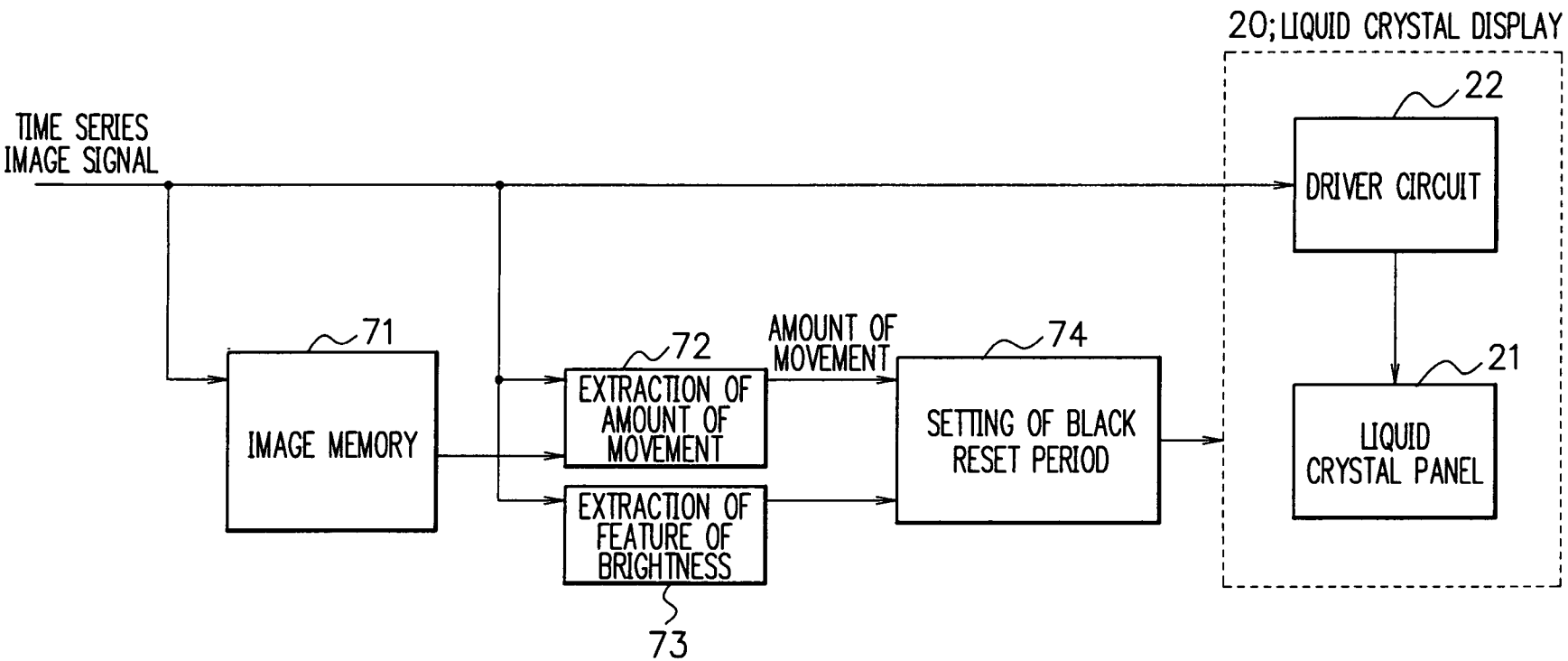
FIG. 7 is a diagram showing a configuration of a third embodiment of the present invention schematically showing a liquid crystal display which conducts setting of a black reset period according to an amount of movement and a feature of brightness.

FIG. 7 is a diagram showing a configuration of a third embodiment of the present invention. FIG. 7 shows an example of a liquid crystal display setting a black reset period according to an amount of movement and a feature of brightness. The difference between the configuration of this embodiment and that of the embodiment shown in FIG. 4 setting a black reset period according to an amount of movement resides in that this embodiment includes a new unit, i.e., the brightness feature extracting section 73 to extract a brightness feature using a time series image signal. The black reset period setting section 74 sets a black reset period using the decision conditions shown in FIG. 6 according to the amount of movement extracted by the movement amount extracting section 72 and the brightness feature extracted by the brightness feature extracting section 73. FIG. 7 shows a case using a time series image signal as input signal; however, by disposing a similar brightness feature extracting section 73, a similar advantage of operation can be obtained even when an encoded digital signal such as an encoded signal of MPEG2 is used as input signal.

In this embodiment, several values are used for the brightness feature. When an RGB signal is inputted as the time series image signal, mean luminance of a frame image can be obtained as the brightness feature. Since a Y signal indicating luminance can be represented as a linear combination of RGB signals, the mean luminance is calculated by easily by conducting a color conversion for each pixel.

Figure 8:
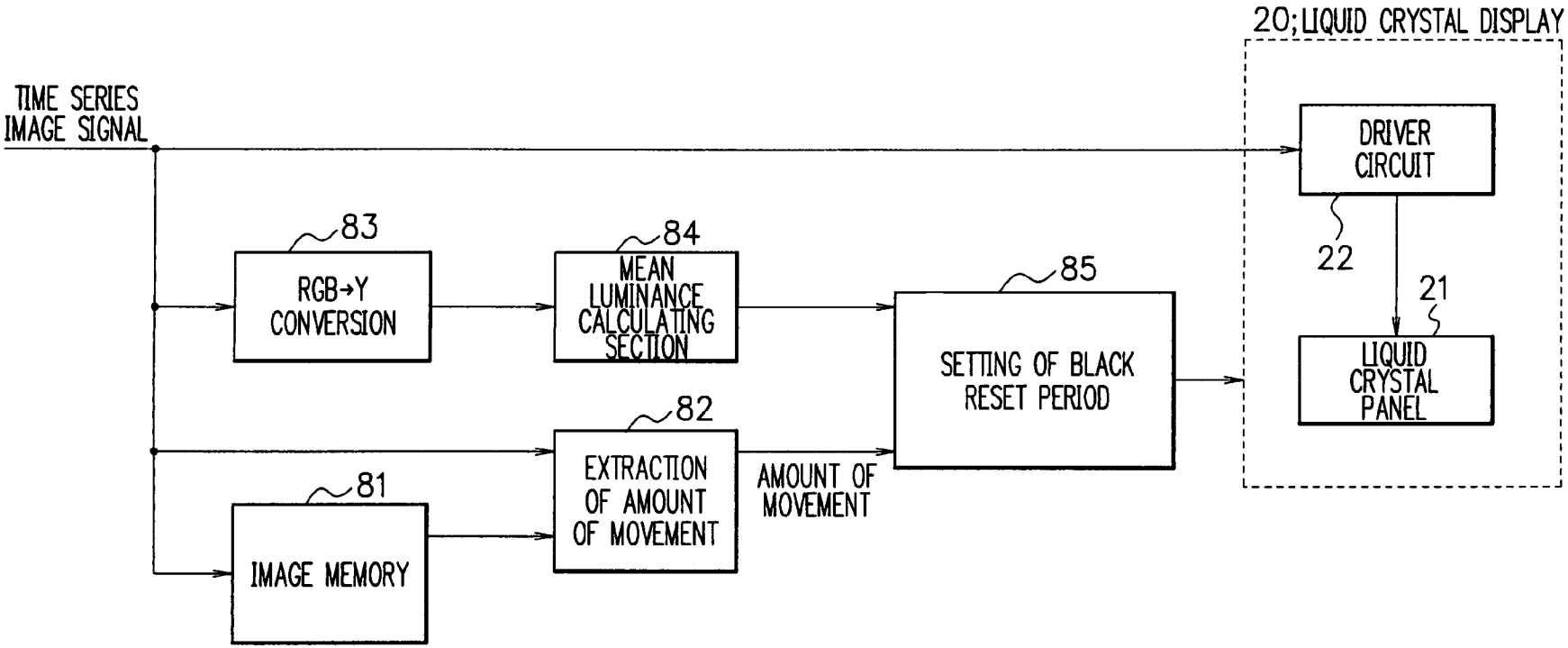
FIG. 8 is a diagram showing a configuration of a fourth embodiment of the present invention schematically showing a liquid crystal display which conducts, when an RGB signal is inputted as a time series image signal, setting of a black reset period according to mean brightness and an amount of movement of the image.

FIG. 8 is a diagram showing a configuration of a fourth embodiment of the present invention, namely, is a diagram showing an example of a liquid crystal display in which an RGB signal is inputted as a time series image signal. Referring to FIG. 8, the configuration includes, as a feature extracting section which inputs a time series image signal to extract a brightness feature thereof, an RGB→Y converting section 83 to convert an RGB signal into a Y signal and a mean luminance calculating section 84. The output (mean luminance) from the mean luminance calculating section 84 and the amount of movement delivered from the movement amount extracting section 82 are fed to the black reset period setting section 85 in which the black reset period is determined according to the amount of movement and the mean luminance.

Moreover, a signal including a luminance signal as a component (for example, an NTSC composite signal) is used as the time series image signal, the mean luminance can be calculated without executing the color conversion processing.

Additionally, in the setting of the ratio of the black reset period, a more effective setting operation can be conducted by using maximum luminance and a brightness feature such as an areal ratio of a component having higher luminance.

Figure 9:
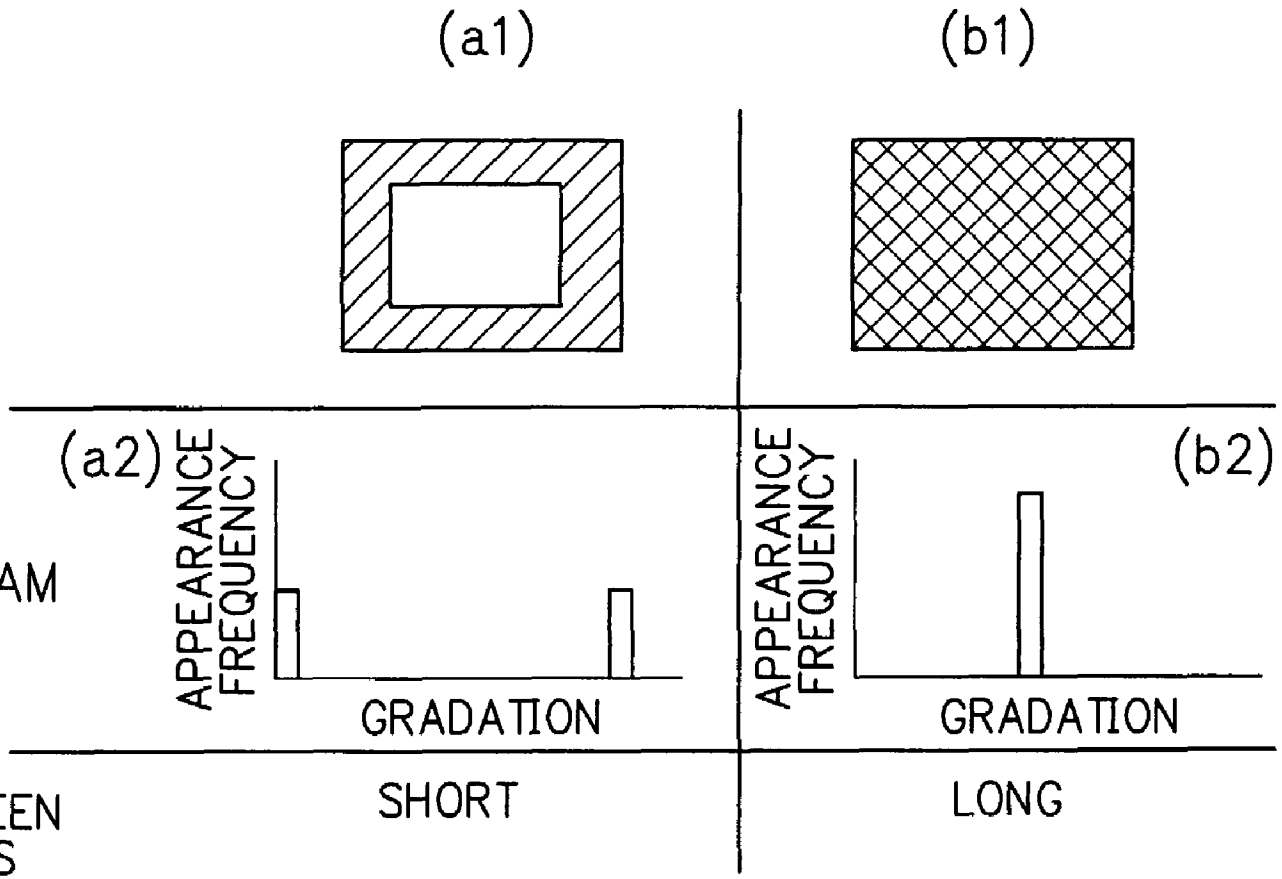
FIG. 9 is a diagram to explain a principle of operation of an embodiment of the present invention showing a frame image, a histogram thereof, and an example of setting of a black reset ratio according to the histogram.

FIG. 9 shows a frame image and its histogram (a graph showing a gradation level and an appearance frequency thereof) and a setting operation of the black reset ratio according to the histogram. In this connection, the same amount of movement is set to FIG. 9 (*a*) and FIG. 9 (*b*).

In FIG. 9 (*a*), a portion of the most bright gradation level occupies a half of the screen, but the mean luminance is just at an intermediate level.

In FIG. 9 (*b*), the entire screen is at about the mean luminance level.

In this case, the ratio of the portion including a higher luminance component is higher in FIG. 9 (*a*) and is lower in FIG. 9 (*b*).

Consequently, when the ratio of the portion including a higher luminance component (FIG. 9 (*a*)) becomes higher, the ratio of the black reset period is reduced to suppress the reduction of luminance in the portion.

As a result, a liquid crystal display having a good balance of brightness and moving picture quality can be obtained by setting the black reset period using the amount of movement and brightness features such as mean luminance, maximum luminance, and an areal ratio of a component having higher luminance.

Although the setting of the black reset period in each embodiment of the present invention has been discussed, the gradation output is directly conducted regardless of a histogram of an image displayed on the liquid crystal display.

Next, description will be given of a fact that a liquid crystal display having a wider dynamic range can be obtained by further conducting a gradation correction.

Figure 10:
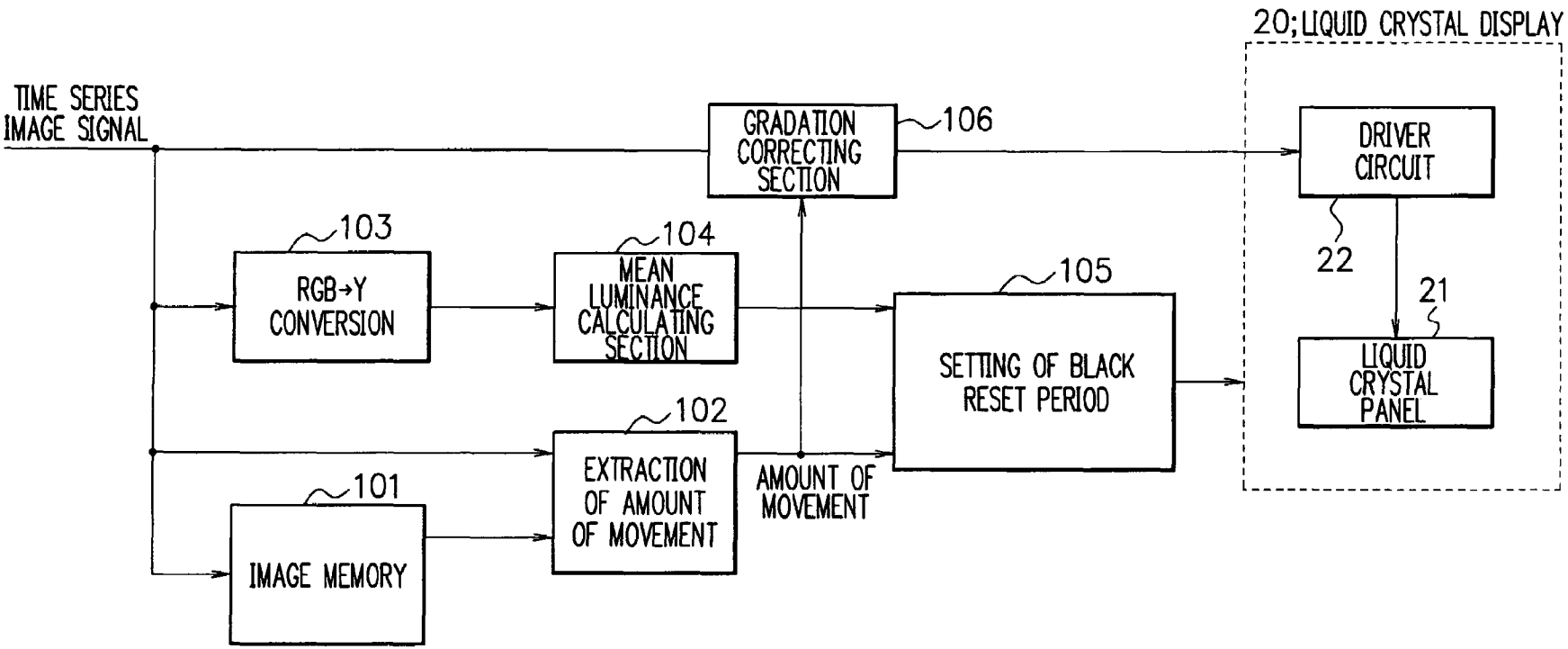
FIG. 10 is a diagram showing a configuration of a fifth embodiment of the present invention schematically showing a configuration of a liquid crystal display which sets a black reset period according to an amount of movement and mean luminance and which conducts correction of gradation according to the amount of movement.

FIG. 10 shows a configuration of a fifth embodiment of the present invention. FIG. 10 shows a configuration of a liquid crystal display setting a black reset period according to an amount of movement and mean luminance and conducting correction of gradation according to the amount of movement. Referring to FIG. 10, an RGB→Y converting section 103, an image memory 101, a movement amount extracting section 102, a mean luminance calculating section 104, and a black reset period setting section 105 are the same as the RGB→Y converting section 83, the image memory 81, a movement amount extracting section 82, the mean luminance calculating section 84, and the black reset period setting section 85 of FIG. 8. This embodiment includes a gradation correcting circuit 106 which inputs a time series image signal and an amount of movement from the movement amount extracting section 102 to correct gradation of the time series image signal according to the amount of movement. The black reset period is set in almost the same setting method as for the liquid crystal display of FIG. 8.

In this embodiment, the black reset period is set according to the amount of movement and the mean luminance, and even when the mean luminance is the same, a different value is set to the period if the amount of movement varies depending on cases.

That is, depending on timing to set or to change the black reset period, the brightness of the display image from the liquid crystal display section 20 may generally varied.

In this situation, to suppress the variation, the gradation correcting section 106 corrects the time series image signal so that the mean luminance of the image is not varied according to the amount of movement.

Figure 11:
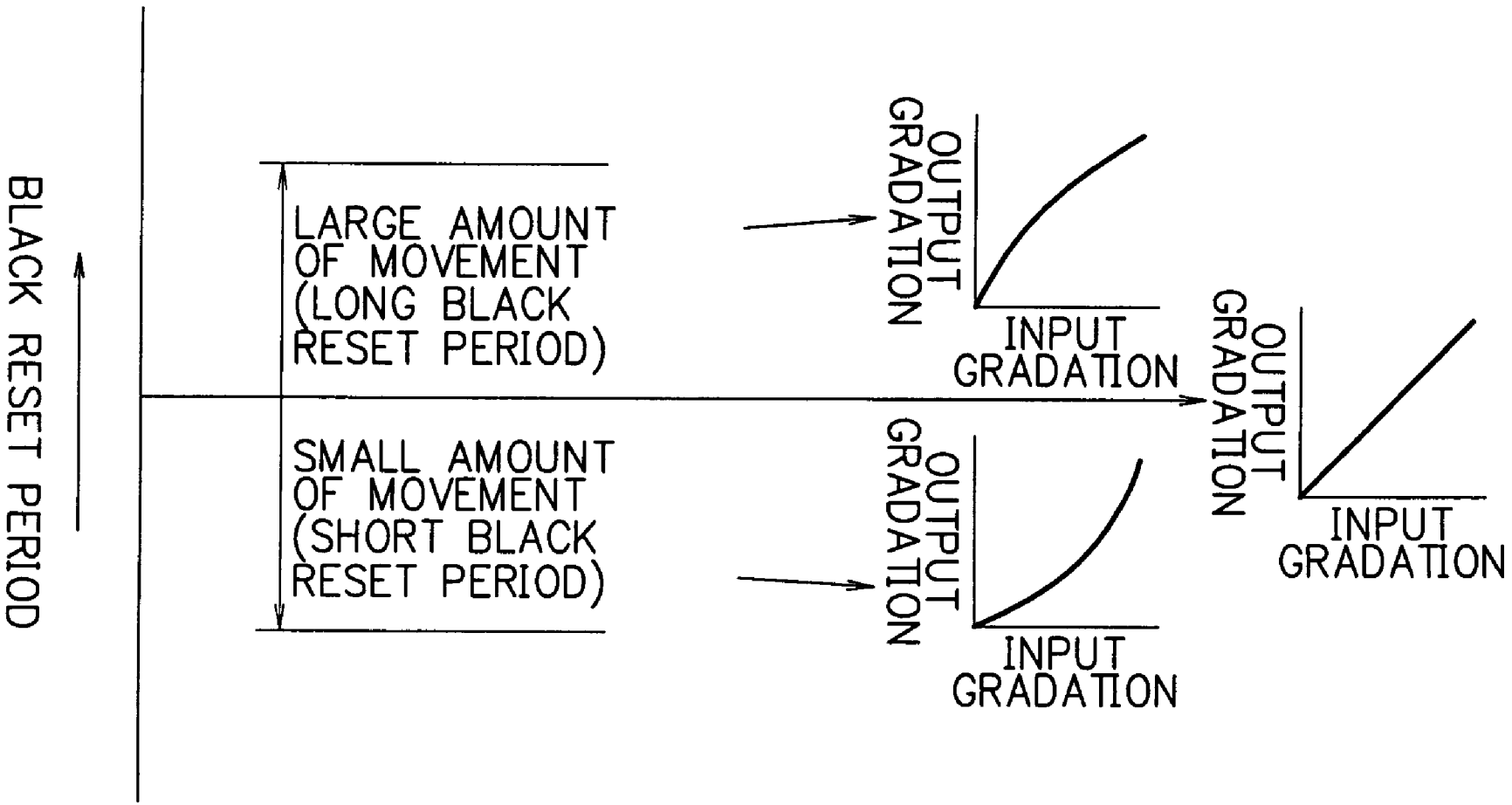
FIG. 11 is a diagram to explain an example of correction of a time series image signal in the fifth embodiment of the present invention.

FIG. 11 is a diagram to explain an example of a specific correction by the gradation correcting section 106 in this embodiment. Since the black reset period becomes long when the amount of movement is large in an image, the mean luminance is increased using gradation as much in the correction. A relationship between input gradation (abscissa) and output gradation (ordinate) is represented by an upwards convex curve.

Since the black reset period becomes short when the amount of movement is small, the mean luminance is decreased using gradation. A relationship between input gradation (abscissa) and output gradation (ordinate) is represented by a downwards convex curve.

In this way, the mean luminance of the liquid crystal display can be kept fixed. Moreover, to remove this problem, a light source having controllable brightness is used such that when the black reset period becomes long according to the amount of movement on a screen, the light source is made to be brighter; and when the period becomes short according to the amount of movement, the light source is made to be darker. It is also possible to thereby obtain a similar advantage.

On the other hand, as an advantage to conduct the gradation correction, a clear image can be obtained by emphasizing gradation on a brighter side for a bright image and by emphasizing gradation on a darker side for a dark image.

Figure 12:
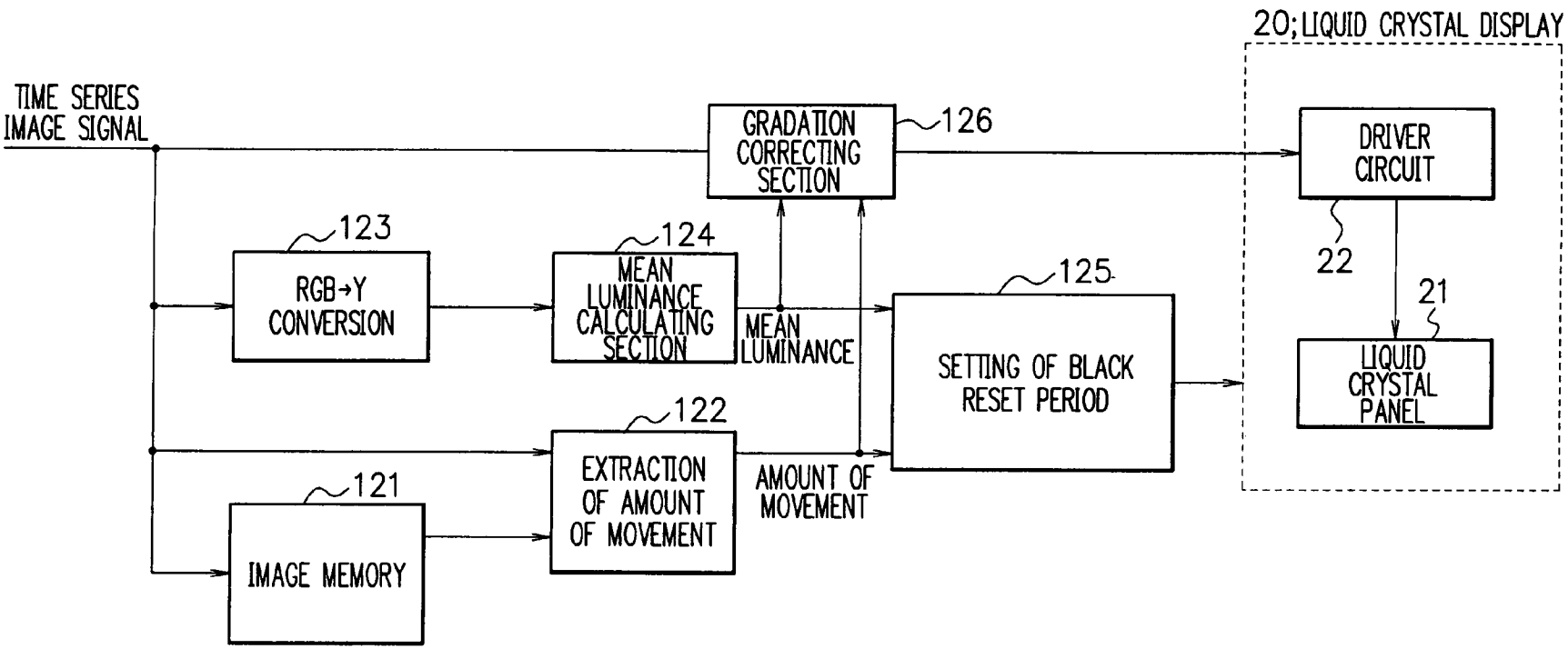
FIG. 12 is a diagram showing a configuration of a sixth embodiment of the present invention schematically showing a liquid crystal display including a gradation correcting section to conduct correction of gradation according to the amount of movement and mean luminance.

FIG. 12 is a diagram showing a configuration of a sixth embodiment of the present invention. Referring to FIG. 12, a liquid crystal display in accordance with the embodiment includes a gradation correcting section 126 to conduct correction of gradation according to the amount of movement and mean luminance. As distinct from the configuration shown in FIG. 10, the gradation correcting section 126 receives as inputs a time series image signal, an amount of movement, and mean luminance.

The gradation correcting section 126 checks brightness of the overall image using mean luminance of the image produced from the mean luminance calculating section 124 and conducts the gradation correction to emphasize a gradation difference on a bright side when the image is bright. On the other hand, the section 126 conducts the gradation correction to emphasize a gradation difference on a dark side when the image is dark.

Figure 13:
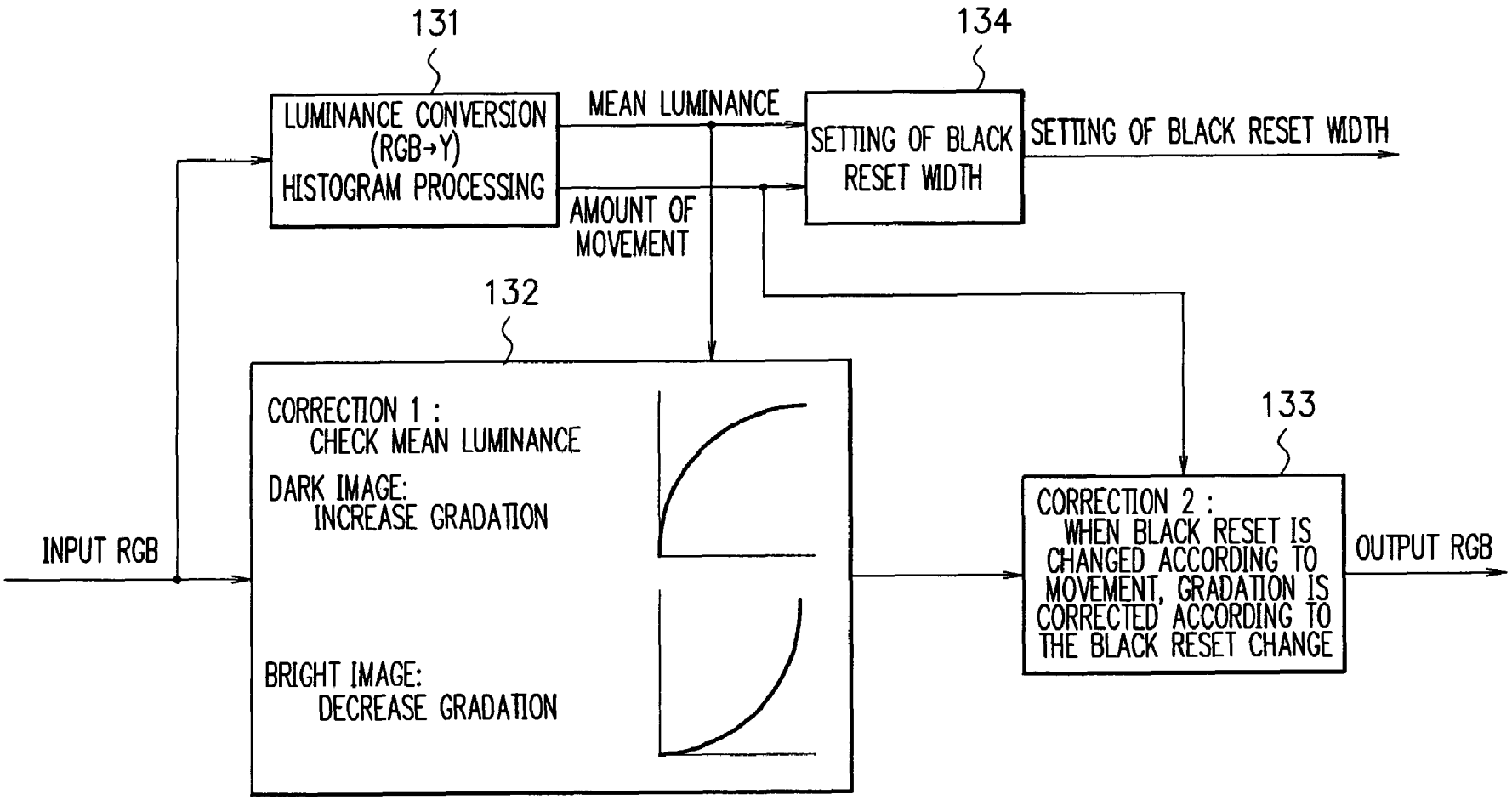
FIG. 13 is a block diagram to explain a method of conducting setting of a black reset period and correction of gradation using an input image signal in the sixth embodiment of the present invention.

FIG. 13 is a diagram showing processing of gradation correcting section 126 in functional blocks. The section 126 correct gradation in two stages of steps (corrections 1 and 2).

The section 126 receives as an input an input RGB signal and executes luminance conversion (RGB→Y) histogram processing to produce mean luminance and an amount of movement (131). In correction 1 (132), the section 126 receives as inputs the mean luminance and the input RGB signal and checks the mean luminance to increase input gradation when the image is dark and to decrease input gradation when the image is bright. In correction 1 (132), when the black reset is beforehand changed according to the movement, the section 126 conducts the gradation correction according to the change and produces an output RGB signal. In FIG. 13, the gradation correcting section 126 includes two stages for easy understanding thereof, however, these stages may be combined with each other to execute the processing in one stage of the step.

Next, description will be given of an embodiment of the present invention according to a method to actually set a black reset period.

Figure 14:
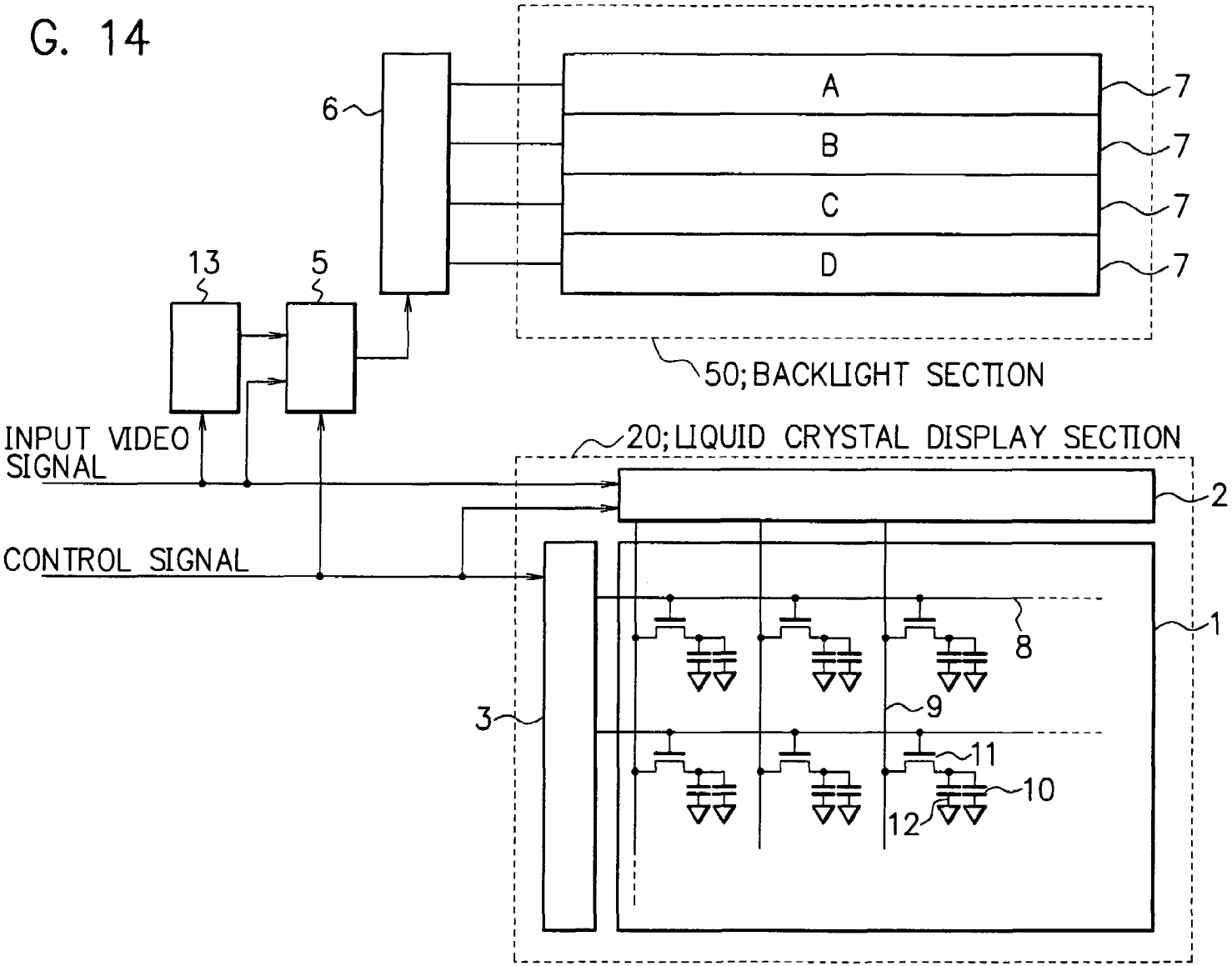
FIG. 14 is a diagram schematically showing a configuration of a liquid crystal display in the first embodiment of the present invention.

FIG. 14 is a diagram schematically showing a liquid crystal display in the first embodiment of the present invention. The pixel section (a thin film transistor (TFT) 11 to serve as a pixel switch, an auxiliary capacitor 12, and a liquid crystal layer) is partly magnified and shown in FIG. 14.

Referring to FIG. 14, the liquid crystal display of this embodiment includes a liquid crystal display section 20 including a display panel 1 at least including a plurality of scanning lines 8 and a plurality of signal lines 9 mutually intersecting each other, a plurality of pixels 10 disposed at the respective intersections in a matrix form via respective thin film transistors 11, and auxiliary capacitors 12 connected in parallel, a scanning line driver 3 to control the scanning lines 8, and a signal line driver 2 to control the signal lines 9; a backlight section 50 including a plurality of lighting devices 7, a light driving section 6 to control on and off of the lighting devices 7 in an independent way, a control signal generating section 5 to send a control signal to the light driving section 6 according to an input video signal and a control signal, and an image memory 13 to store a video signal of a frame immediately before a current frame. The backlight section 50 is placed on a rear surface of the liquid crystal display section 20 and is arranged in the liquid crystal display device.

Description will be given of operation of the respective sections of FIG. 14. To display an image on the liquid crystal display section 20, a converted input video signal and control signals such as a horizontal synchronizing signal HSync, a vertical synchronizing signal VSync, and a clock signal CLK are inputted. The input video signal and the control signals are directly fed to the liquid crystal display section 20. For the input video signal inputted to the signal line driver 2, data rearranging and a conversion from a digital signal to an analog signal (D/A conversion) are conducted such that an analog signal is outputted to the signal lines 9. On the other hand, for the scanning line driver 3, one line or row of pixels are selected by the scanning line 8, the transistors 11 on the selected row turn on, and signals from the signal lines 9 are written in selected pixels. Since the liquid crystal display conducts "line sequential scanning", the signal is written in pixels for each scanning line 8.

The signal written via the transistor 11 from the signal line 9 is supplied to the pixel 10 and the auxiliary capacitor 12 to be charged to a signal line voltage (selection period). Thereafter, even when the transistor 11 enters an off state, the signal voltage is kept in the pixel 10 and the auxiliary capacitor 12 and is kept retained until a subsequent selection period (retention period). In this regard, since the response time of liquid crystal ranges from several milliseconds (ms) to several tens of milliseconds (ms) and is long as compared with the selection period, the orientation of liquid crystal changes and the transmissivity varies also during the retention period.

The backlights 7 is subdivided at least in a direction parallel to the scanning lines 8 of the liquid crystal display section 20 and are sequentially turned on and off by the light driving section 6 like the line sequential writing in pixels.

The control signal generator 5 generates control signals (a signal to turn the backlight 7 on, a signal to control turn off timing) and sends the signals to the light driving section 6.

The control signal generator 5 produces signals to control on and off timing of the backlight 7 according to an input signal video signal, a video signal of a frame immediately before a current frame accumulated in the image memory 13, and control signals.

Figure 15:
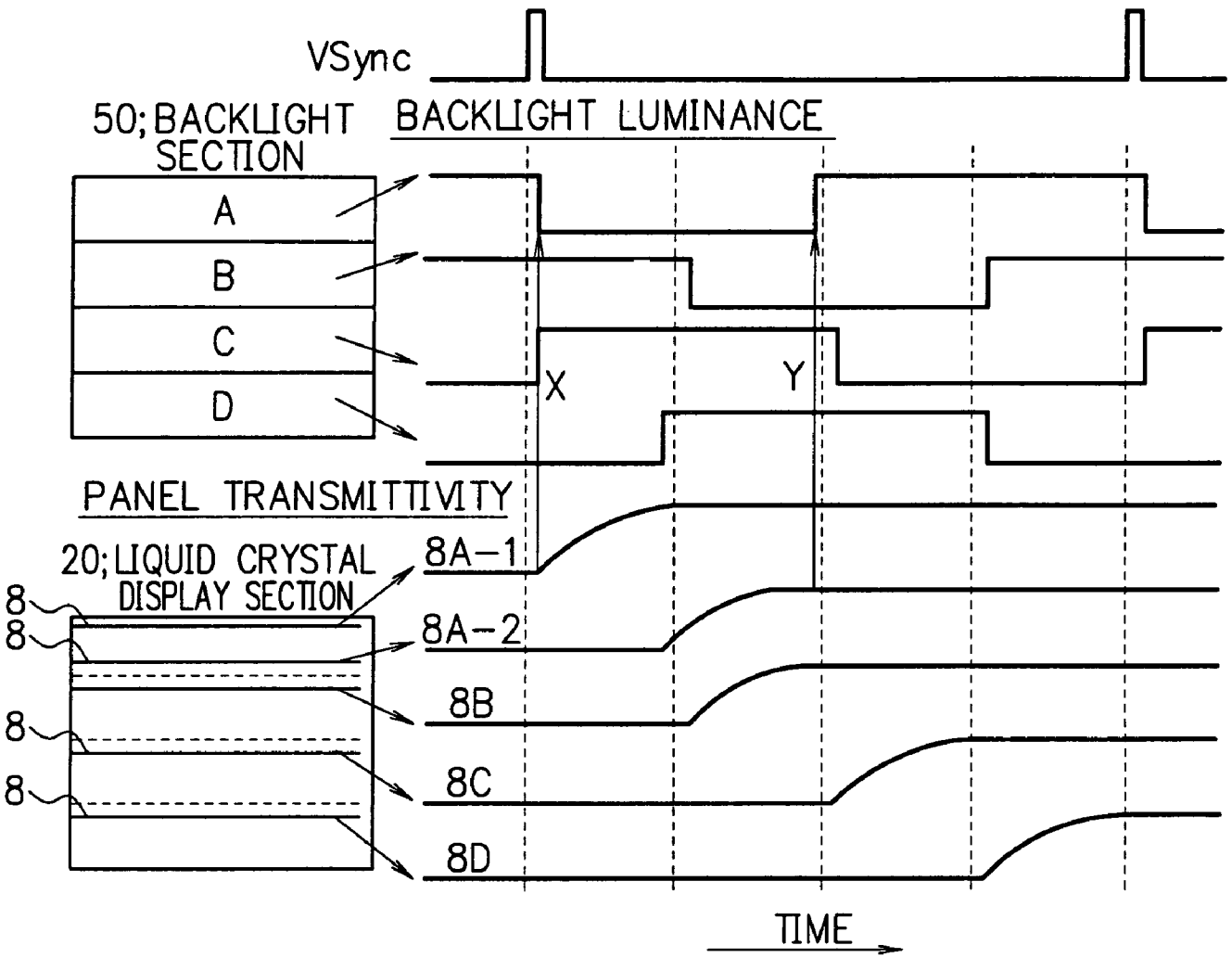
FIG. 15 is a diagram to explain driving timing of the liquid crystal display of FIG. 14.

Next, an operation principle of the liquid crystal display will be described by referring to a signal timing chart. FIG. 15 is a diagram showing driving timing of the liquid crystal display of FIG. 14. The vertical synchronizing signal VSync is a pulse signal turned on at an interval of a vertical period. FIG. 15 shows a relationship between luminance of respective backlights A, B, C, and D of the backlight section 50 and the transmissivity of liquid crystal pixels of lines of the liquid crystal display section 20 corresponding to the respective backlights A, B, C, and D.

In the liquid crystal display section 20, a voltage is sequentially applied to the scanning lines 8 beginning at an upper scanning line 8 at a period of one frame to turn the transistors 11 located in the row of the scanning line 8 on to write a video signal in pixels 10. The transmissivity of the liquid crystal changes several milliseconds after the writing operation.

In this diagram, the scanning lines 8A-1 and 8A-2 are respectively a line on which the pixel writing operation is first conducted and a line on which the pixel writing operation is last conducted among the lines included in a backlight area A. As can be seen from a time-transmissivity characteristic of the lines 8A-1 and 8A-2, from when the transmissivity change of pixels in the line 8A-1 starts to when the transmissivity change of pixels in the line 8A-1 ends, all pixels 10 of the liquid crystal display section 20 included in the backlight area A do not become stable.

Resultantly, to improve the mobile picture quality, it is desirable that the backlight A turns off (arrow x in the diagram) when the writing starts in the pixels corresponding to scanning line 8A-1 in the upper-end of the zone A and turns on (arrow Y in the diagram) when the response of the pixels corresponding to scanning line 8A-2 in the lower-end of the zone A finished. This is also the case with the backlights B, C, and D.

Thanks to the configuration, by inserting the turn off period, namely, the "black" display in a hold type display, i.e., an LCD, the mobile picture quality can be improved.

The improvement in the mobile picture quality up to this point can also be similarly obtained also using the black reset driving method.

The difference with respect to the black reset insertion by the driving of this embodiment resides in that the light source is actually turned off and hence luminance in the "black" display is further lowered in this embodiment.

In the embodiment, by referring to a type of video signal and a gradation histogram of a display image, black reproducibility is regarded as important, and when the video image is generally dark, the mobile picture quality is improved using the gradation correction and the change of on time of the backlight, and there can be obtained a liquid crystal display superior in gradation reproducibility.

In this connection, a combination with the black reset driving is also applicable to the present invention, and also when the black reset driving is applied to the present invention, there can be naturally obtained a remarkable advantage.

Since the liquid crystal driving circuit conducts the line sequential scanning, it is desirable that the backlight is also divided into subareas according thereto to conduct the line sequential scanning.

However, since the cost and the power consumption greatly increase, the number of backlight subareas is limited. As described above, the timing to turn the backlight on and off need only be controlled.

Figure 16:
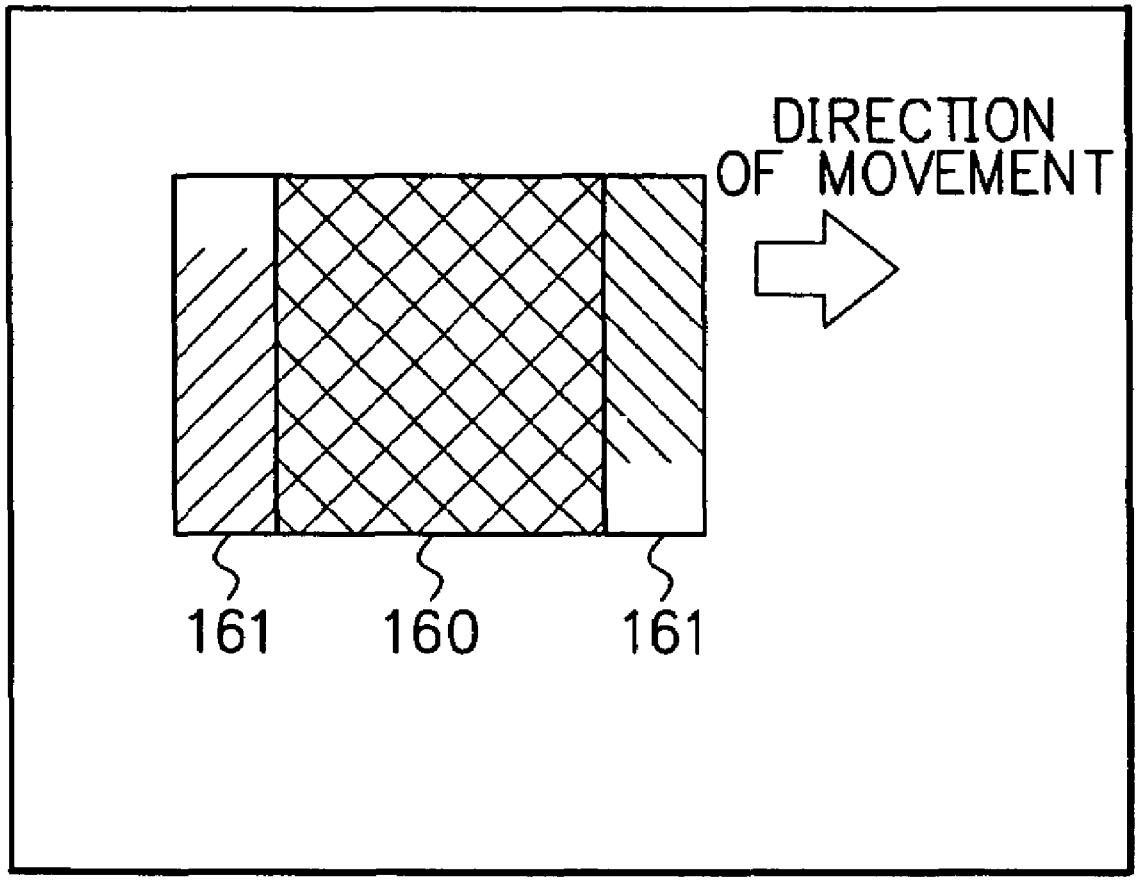
FIG. 16 is an example of picture quality reduction occurring when the number of subareas of a backlight is too small.

However, when the number of backlight subareas is too small or when lighting devices are turned on before the complete response of liquid crystal to increase luminance, for example, when a black rectangle 160 (crosshatched for convenience of drawing) moves in a direction from the left to the right on a white background, gradation areas 161 (hatched for convenience of drawing) appear in ghost zones as shown in FIG. 16. Therefore, it is required to set an optimal number of backlight subareas.

As above, description has been given of the backlight control method and timing and it has been described that the black reset period can be set. By setting the ratio of the black reset period according to the amount of movement by use of the control signal generator 5, there can be implemented a liquid crystal display in which the reduction in brightness is suppressed and the mobile picture quality is improved.

It is naturally possible that the first embodiment is configured such that the movement amount extracting section, brightness feature extracting section, the mean luminance calculating section, and the gradation correcting section described by respectively referring to FIGS. 4, 7, 8, 10, and 12 are arranged in the control signal generator 5 or outside the generator 5.

The input video signal is an RGB signal in the description; however, any encoded digital signal including vector information such as an MPEG2 signal can be used without necessity of the image memory 13 such that movement vector information is extracted from the signal and is fed to the control signal generator 5.

Figure 17:
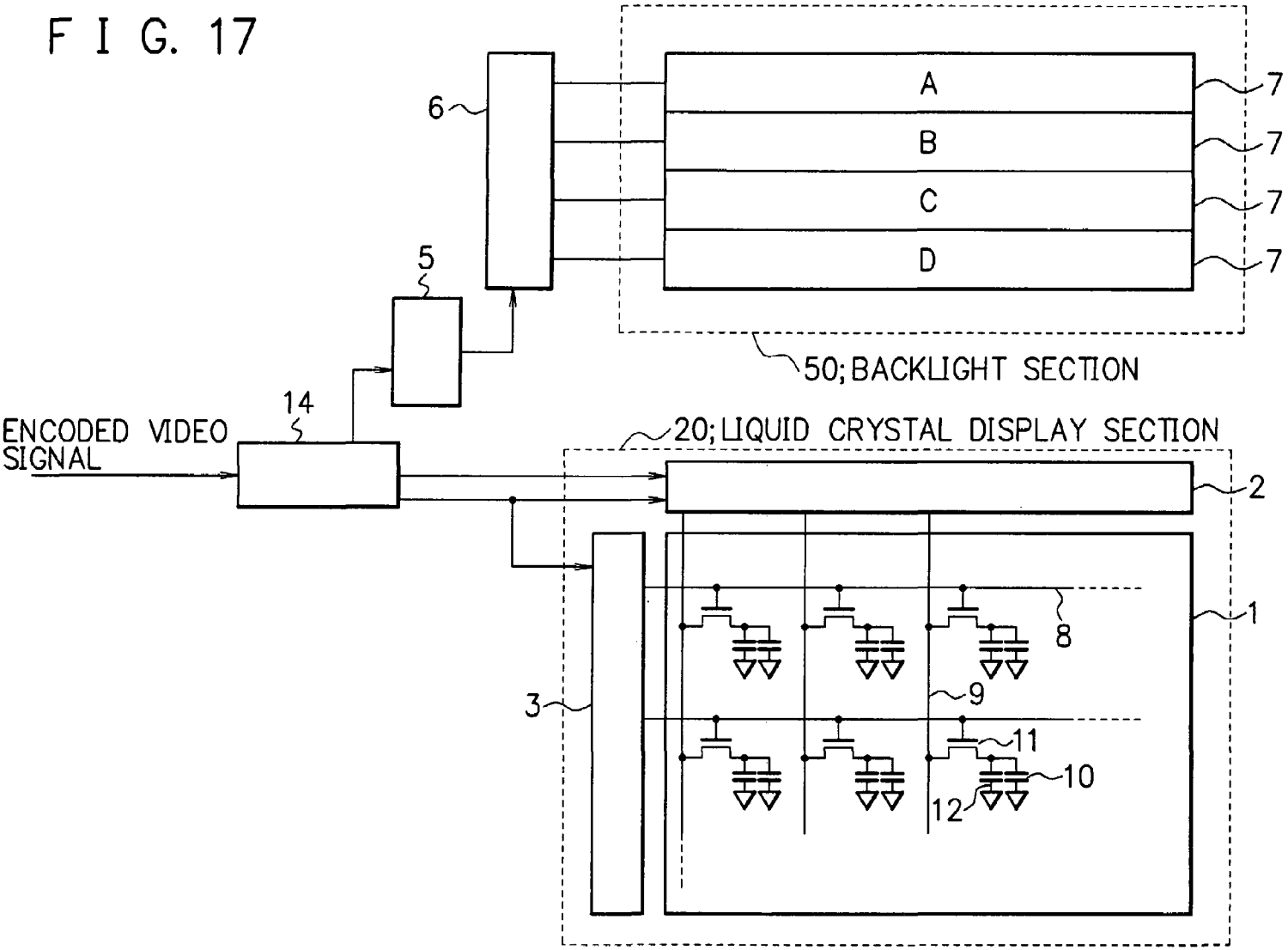
FIG. 17 is a diagram schematically showing a configuration of a liquid crystal display in the second embodiment of the present invention.

FIG. 17 is a diagram schematically showing a configuration of a liquid crystal display in the second embodiment of the present invention. The embodiment differs from the liquid crystal display in the first embodiment in that this embodiment includes a decoding circuit 14 to decode the encoded video signal and the control signal generator 5 sets the black reset period using movement vector information obtained by the decoding circuit 14. The configuration of this embodiment does not require the image memory 13 of the first embodiment. The other configuration is the same as that of the first embodiment.

Figure 18:
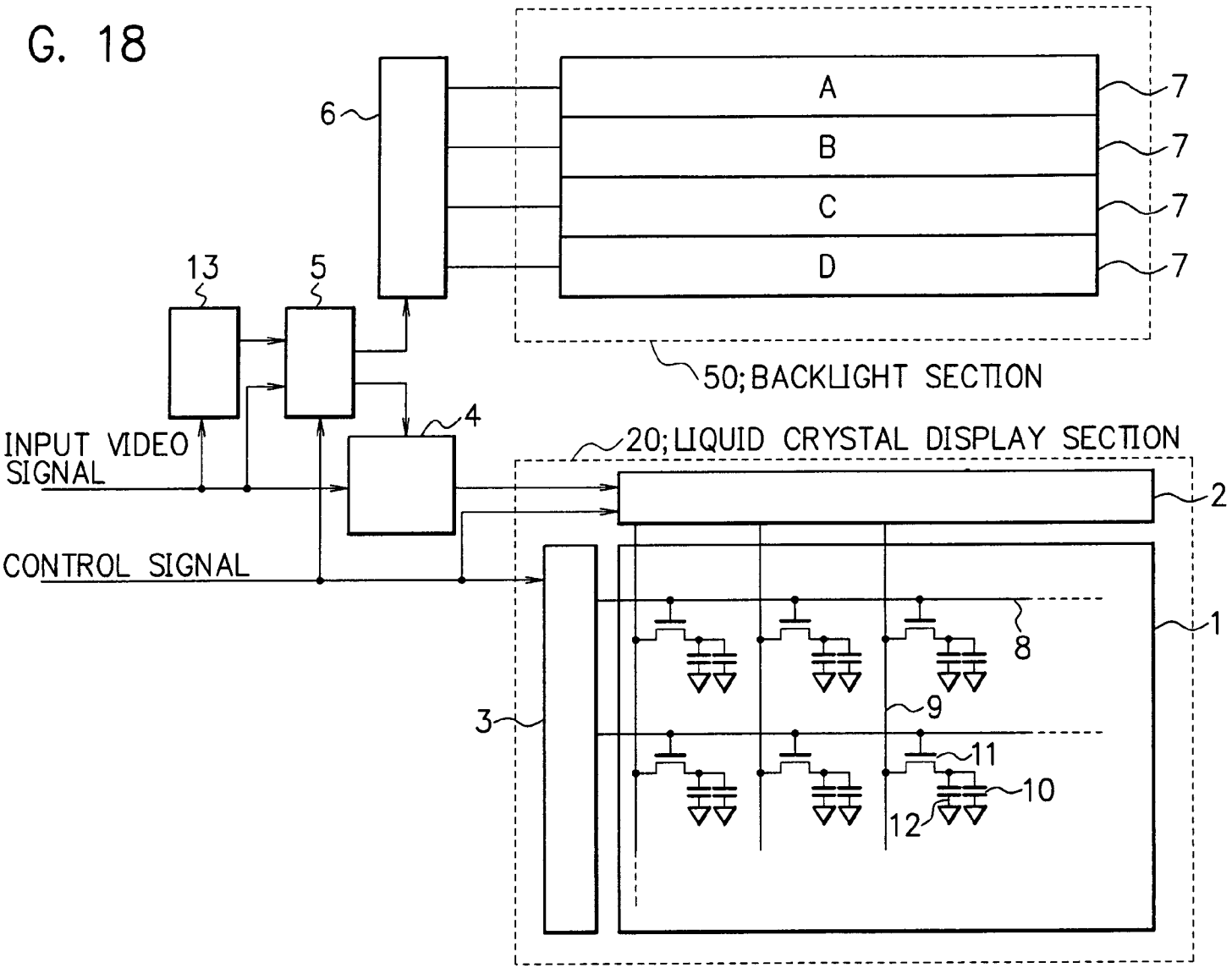
FIG. 18 is a diagram schematically showing a liquid crystal display in the third embodiment of the present invention.

FIG. 18 is a diagram schematically showing a liquid crystal display in the third embodiment of the present invention. The embodiment differs from the liquid crystal display in the first embodiment of FIG. 14 in that the control signal generator 5 sets the black reset period and there is disposed a gradation correcting section 4 to conduct gradation correction for an input video signal using a control signal sent from the control signal generator 5. The other configuration is the same as that of the first embodiment. According to the embodiment in this configuration, a clearer image can be displayed.

In this regard, in addition to the backlight including cold-cathode discharge tubes arranged in the scanning direction, there can be used areal light emitting devices such as electro luminance elements and light-emission diodes to obtain a similar advantage.

Figure 19:
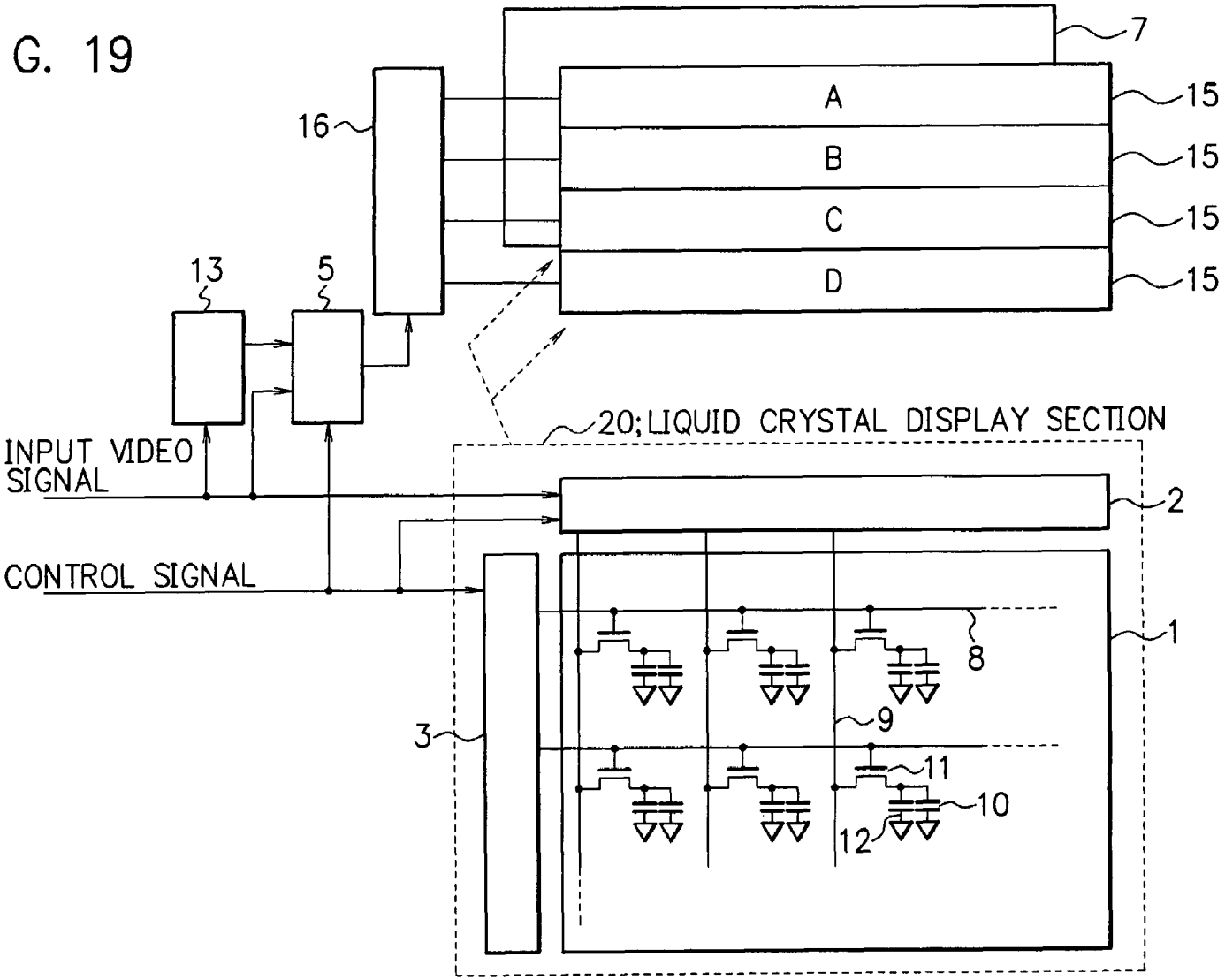
FIG. 19 is a diagram schematically showing a liquid crystal display in the fourth embodiment of the present invention.

Next, description will be given of a fourth embodiment of the present invention. FIG. 19 is a diagram schematically showing a configuration of a liquid crystal display in the fourth embodiment of the present invention. The configuration is different from that of the liquid crystal display in the first embodiment of the present invention shown in FIG. 14 in that although the backlight 7 is of a full area on type, an optical shutter 15 having high contrast is arranged between the backlight 7 and the liquid crystal display section 20 or in front of the display section 20.

The optical shutter 15 is divided into subareas in the scanning direction of the liquid crystal display section 20 and the optical shutter controller 16 can control the subareas in an independent way in this configuration. As the optical shutter 15, ferrodielectric liquid crystal having a high-speed response characteristic is used.

The optical shutter 15 is controlled to interrupt light during the black reset period and to transmit light during the image gradation display period. Timing to control the shutter 15 and a quantity of control are determined in a method equal to that described for the first embodiment. The control signal generator 5 generates control signals to control transmission and interruption timing of the optical shutter 15 according to a video signal inputted thereto, a video signal of a frame before a current frame stored in the image memory, and control signals (VSync, HSync, etc.) and delivers the control signals to the optical shutter controller 16.

Also in this embodiment, like in the first to third embodiments, it is possible to improve the mobile picture quality and to reduce the black luminance.

Incidentally, it is not required to divide the backlight in this embodiment; therefore, the embodiment is applicable not only to a display of direct viewing type but also to a projection type display including a single light source such as a liquid crystal projector. By arranging a gradation correcting section also in the embodiment, a clearer image can be naturally obtained.

Figure 20:
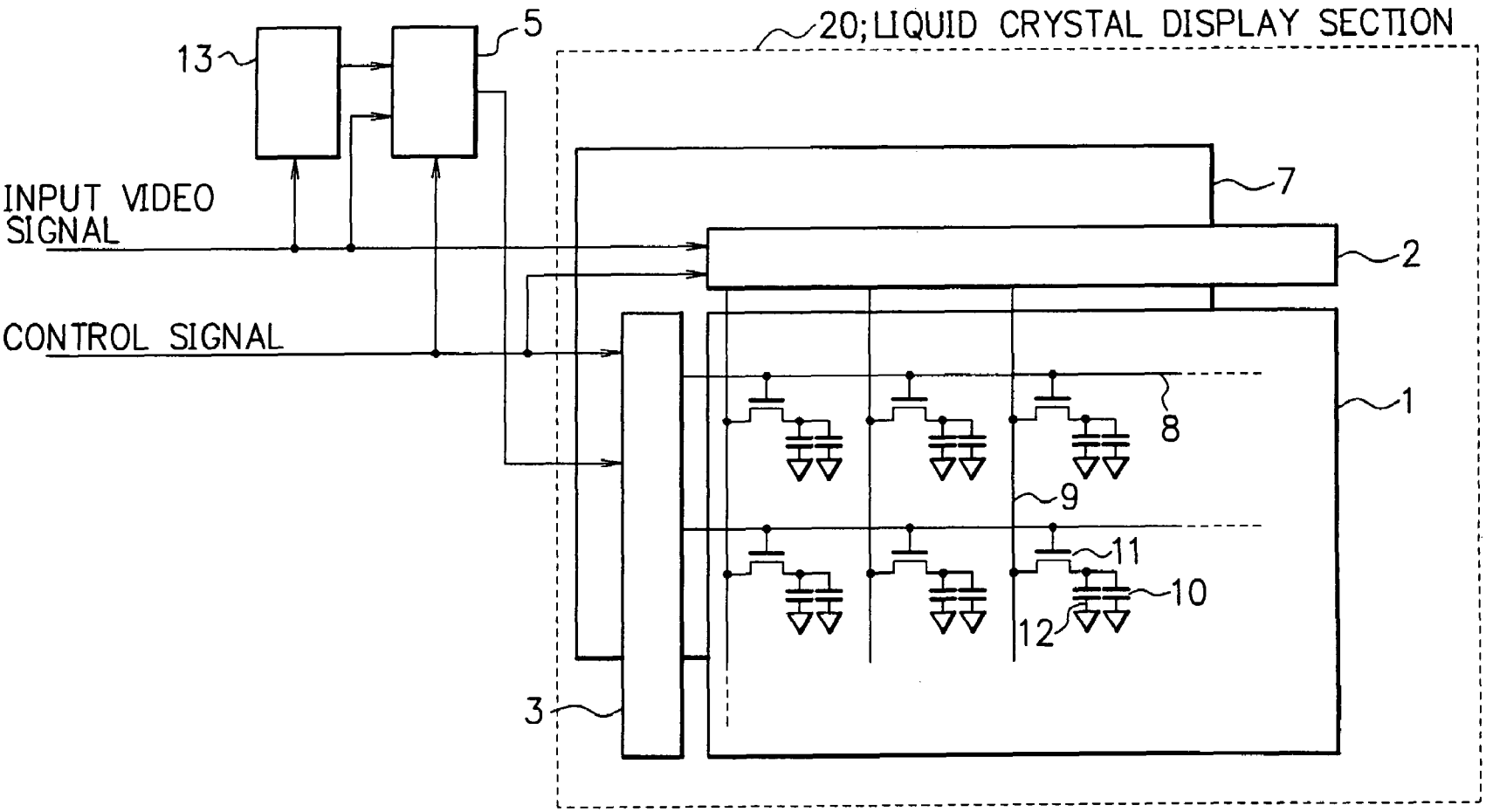
FIG. 20 is a diagram schematically showing a liquid crystal display in the fifth embodiment of the present invention.

FIG. 20 is a diagram schematically showing a configuration of a liquid crystal display in the fifth embodiment of the present invention. This display differs from the liquid crystal displays in the first to third embodiments in that the backlight 7 is of a type of "full area on at a time", and a black reset period setting signal produced from the control signal generator 5 is fed to the scanning line driver 3 of the liquid crystal panel.

Figure 21:
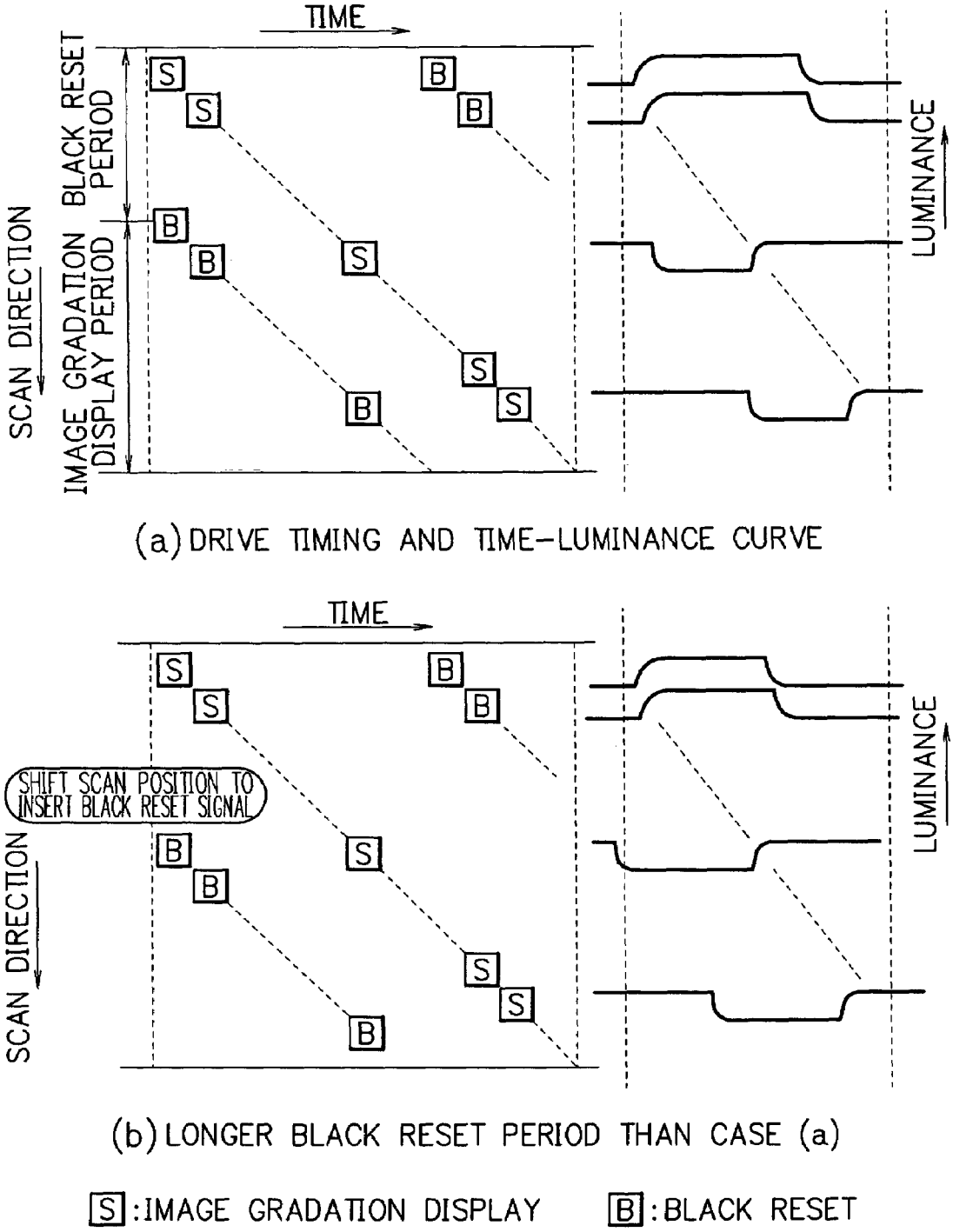
FIG. 21 is a diagram to explain driving timing showing a principle of operation of the fifth embodiment of the present invention.

Description will be given of a driving principle of the liquid crystal display of FIG. 20 by referring to FIG. 21. FIG. 21 shows an image gradation signal to each scanning line, timing to write a black reset signal, and a time-luminance curve associated therewith.

In FIG. 21(*a*), one image gradation display pulse and one black reset display pulse are supplied to each scanning line once during one frame period. The system is set such that when the image gradation display pulse starts at an upper position at a start point of one frame period, the black reset display pulse starts at a position apart in the scanning direction by a distance to insert the black reset from the start point of the image gradation display pulse. Thereafter, as time lapses, the image gradation display pulse and the black reset display pulse respectively shift in the scanning direction at the same speed to drive a subsequent line.

In this situation, since one signal line 9 is disposed for each pixel 10 in the configuration of the liquid crystal panel in the embodiment, the image gradation writing and the black reset writing are conducted for each line during one line selection period.

If two signal lines are disposed for each pixel, it is only necessary to apply a voltage corresponding to the image gradation signal and a voltage corresponding to the black reset voltage to the respective signal lines to select either one thereof. In this way, the black reset writing can be conducted.

FIG. 21(*b*) is a diagram showing timing to write the image gradation display pulse and the black reset display pulse when the black reset period is elongated as compared with FIG. 21(*a*). The scanning start line of the black reset signal is lower than that of FIG. 21(*a*). In this case, the black reset period is elongated in the time-luminance curve of FIG. 21(*b*).

The start position of the black reset display pulse is set according to an output signal from the control signal generator 5. In the black reset driving operation, the black reset width can also be changed according to an amount of movement. Also in this embodiment, the advantage described above is naturally enhanced by adding a gradation correcting section and a brightness feature extracting section.

As above, although the embodiment has been described using an example of a liquid crystal display, the present invention is not restricted by the liquid crystal display, but is naturally applicable to a hold type display.

Figure 22:
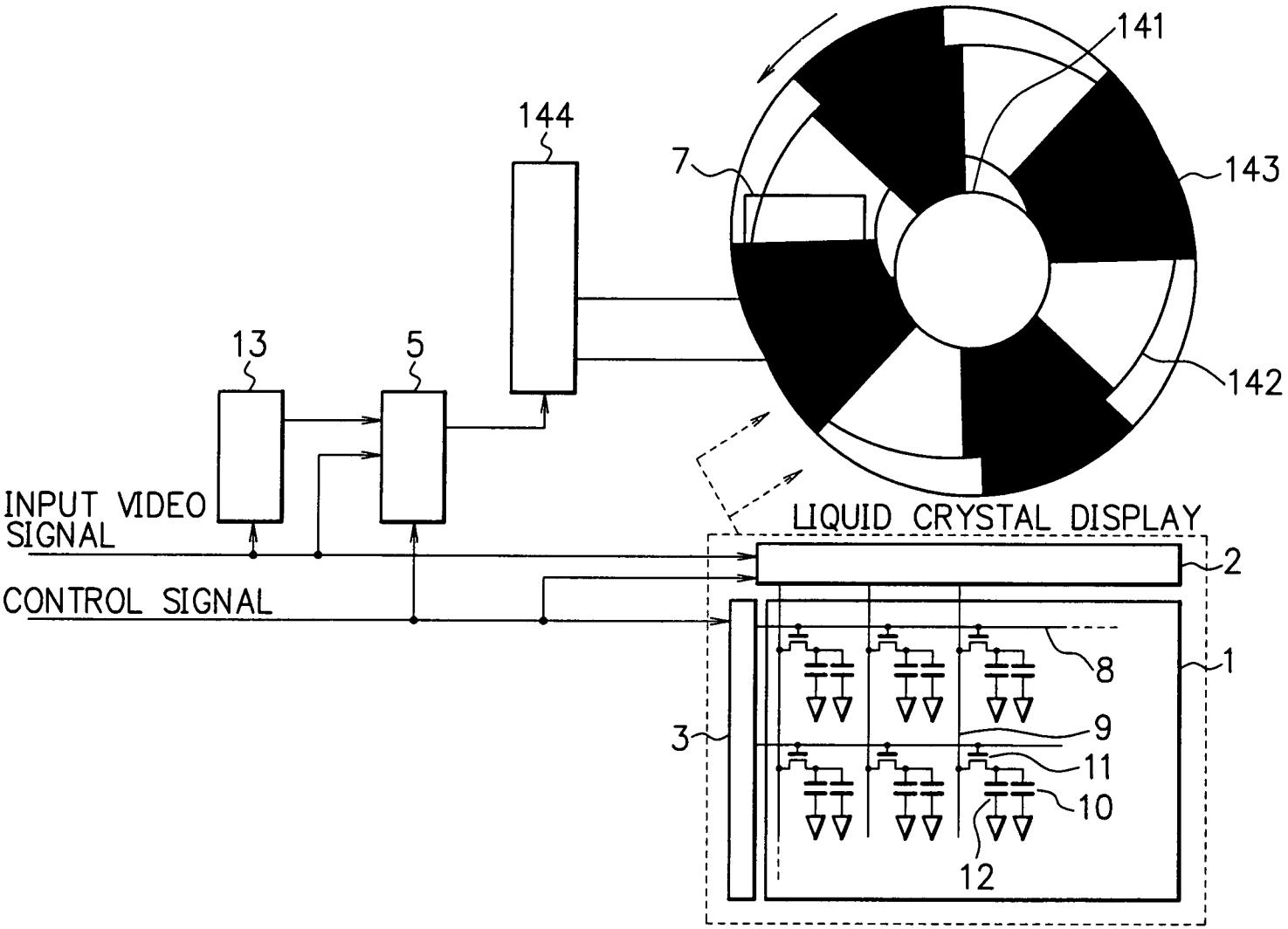
FIG. 22 is a diagram schematically showing a projection liquid crystal display in the sixth embodiment of the present invention.

FIG. 22 is a diagram schematically showing a configuration of a projection liquid crystal display in the sixth embodiment of the present invention. The display differs from the projection liquid crystal display including a single light source in the fourth embodiment in that a plurality of rotary optical shutters 141 are arranged between the backlight 7 and the liquid crystal display section 20 or in front of the display section 20. Moreover, there is disposed an optical shutter control section 144 to control rotation and a phase of each optical shutter. The rotary optical shutter includes a light transmitting zone 142 and a light interrupting zone 143 which are formed alternately with a fixed interval therebetween, and the shutter rotates in association with the scanning and writing operation for pixels of the liquid crystal display section 20. The optical shutter controller 144 controls the rotation. As a result, until the writing operation is finished for the pixels, light for the associated pixels is not projected thanks to the light interrupting zone 143, and only after the writing operation is finished, the display light is projected through the light transmitting zone 141.

Moreover, a plurality of optical shutters disposed in an overlapping fashion can set the respective rotary phases to arbitrary values, and hence the black reset period can be dynamically changed according to the amount of movement and the brightness feature. Assuming, for example, that two optical shutters are used and a ratio between the light transmitting zone and the light interrupting zone is two to one for each shutter, when the light interrupting zones of the shutters completely overlap each other, the ratio between the light transmitting zone and the light interrupting zone is kept as two to one. However, when the light interrupting zones of the shutters do not completely overlap each other and the shutters rotate at the same speed, the ratio becomes one to two. Therefore, when two optical shutters are used and the ratio between the light transmitting zone and the light interrupting zone is two to one, the black reset period can be freely set to a value between ⅓ to ⅔ by changing the rotary phase between the shutters. The optical shutter controller 144 also controls the phase.

Also in this embodiment, the mobile picture quality can be improved and the black luminance can be reduced like in the first to fourth embodiments.

In this connection, by arranging a gradation correcting section in this embodiment, a clearer image can also be naturally obtained.

Figure 23:
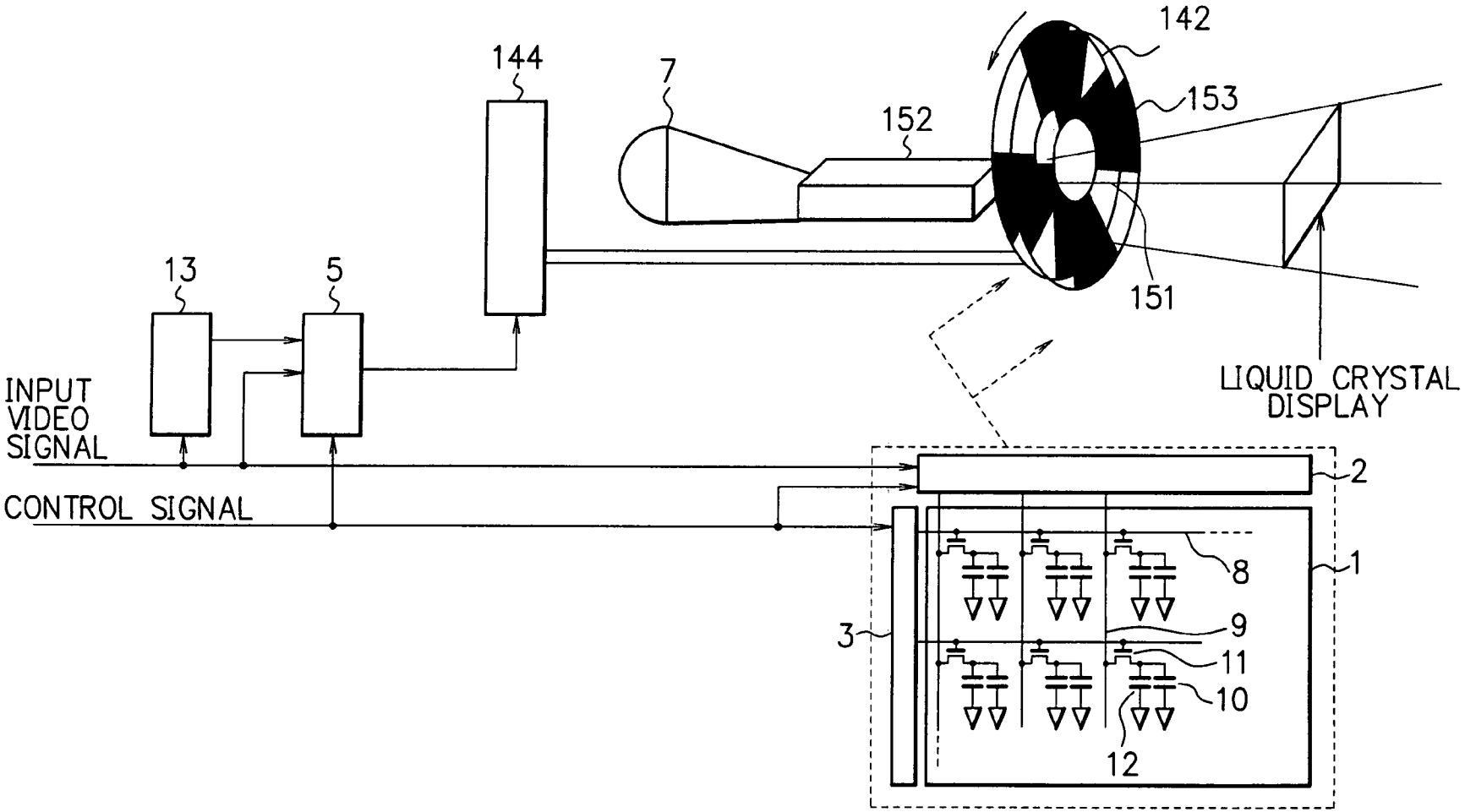
FIG. 23 is a diagram schematically showing a projection liquid crystal display in the seventh embodiment of the present invention.

FIG. 23 is a diagram schematically showing a configuration of a projection liquid crystal display in the seventh embodiment of the present invention. This display differs from the projection liquid crystal display of the sixth embodiment in that an integrator 152 is arranged at a position of a path of light incident to the optical shutters 151 on the light incident side of the optical shutters 151 rotating together in an overlapped state. The configuration of the optical shutters 151 is the same as that of the optical shutters 151 shown in the sixth embodiment, or a light reflecting section 153 is disposed in place of the light interrupting zone 143 of the light shutter 141.

Figure 24:
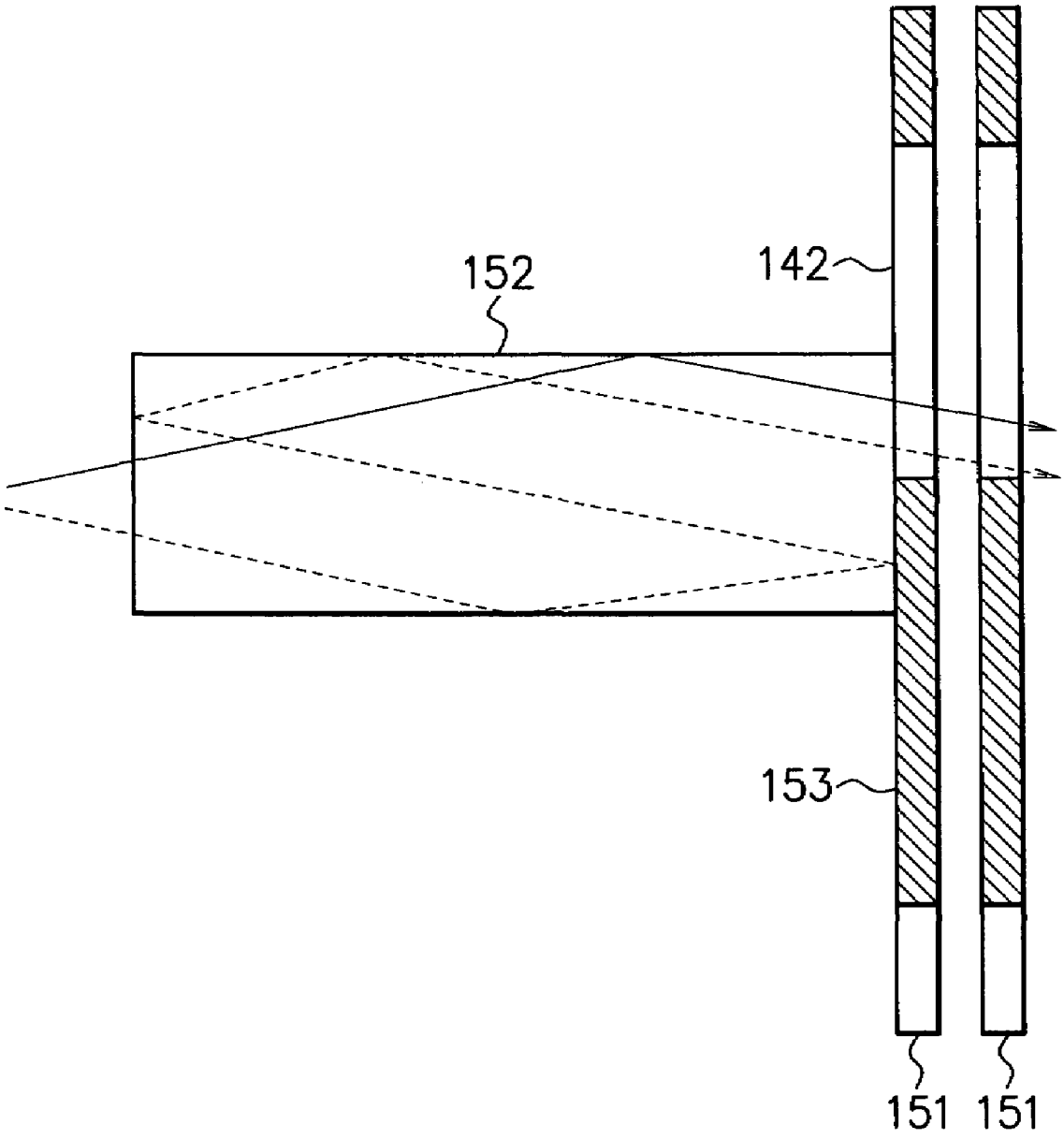
FIG. 24 is a diagram to explain light utilization ratio of the projection liquid crystal display in the seventh embodiment of the present invention.

The integrator 152 has a rod shape and receives light from a light source as shown in FIG. 24, and the light totally reflects in the rod and is emitted from a surface opposing a surface which the incident light enters. The optical shutter 151 is disposed on the light emitting surface such that the light is directly emitted through the light transmitting zone 142, but is reflected on the light reflecting zone 153 and returns again to the integrator. The light repeatedly conducts total reflection to reach the light transmitting zone 142.

As above, by disposing the integrator, the utilization ratio of light from the light source is increased, and hence even when an optical shutter is arranged to set a black reset period, the mobile picture quality can be improved while suppressing the reduction in the maximum luminance.

Moreover, also in this embodiment, it is natural that a clearer image can be obtained by disposing a gradation correcting section.

Figure 25:
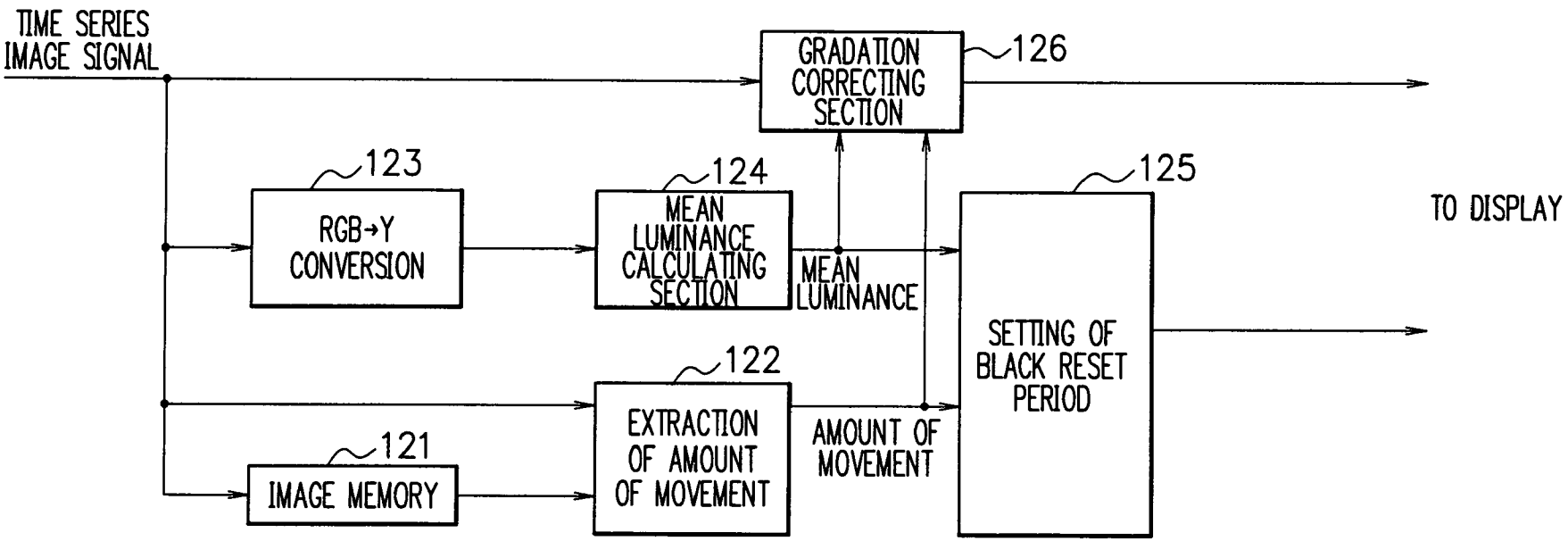
FIG. 25 is a diagram showing an image processing system in an eighth embodiment of the present invention.

FIG. 25 is a diagram showing a configuration of an image processing system in an eighth embodiment of the present invention. This configuration is obtained by removing the display section from the sixth embodiment shown in FIG. 12.

Thanks to the configuration, in a case in which data is transmitted to, for example, a plurality of liquid crystal displays, it is possible by only using this image processing system to provide a liquid crystal display in which the mobile picture quality is improved while suppressing the reduction in the maximum luminance. Furthermore, the transmission destination may be not only the liquid crystal display but also a terminal or a unit such as a portable terminal on which a liquid crystal display is mounted. Since it is only required that a method to set a black reset period is included in the liquid crystal display and the portable terminal, the cost of each liquid crystal display can be lowered without installing a complex algorithm therein.

Additionally, although the configuration of the image processing system is obtained by removing the display section from the sixth embodiment in the description, the configuration does not restrict the image processing system such that the advantage as the image processing system can also be naturally obtained in a configuration implemented by removing the display section from the configurations of each of the first to fifth embodiments.

Figure 26:
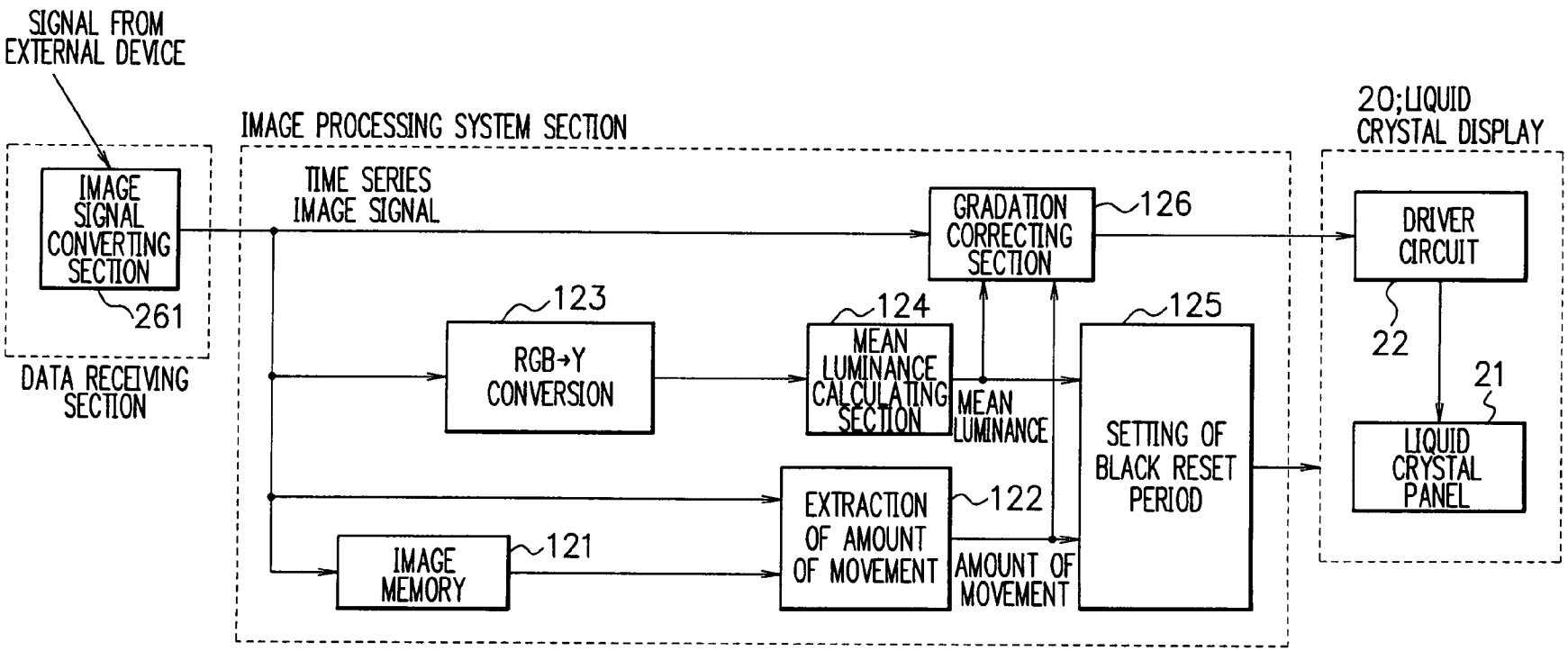
FIG. 26 is a diagram showing a terminal device in a ninth embodiment of the present invention.

FIG. 26 is a diagram schematically showing a terminal device in a ninth embodiment of the present invention. The terminal includes a data receiving section, an image processing system section, and a liquid crystal display section. The configurations of the image processing system section and the liquid crystal display section 20 are the same as those of the sixth embodiment shown in FIG. 12.

The data receiving section receives a signal from an external device and converts the received signal by the image signal converter 261 into a time series image signal.

By using this configuration, the mobile picture quality can be improved and the black luminance can be reduced in the liquid crystal display section arranged in the terminal.

Moreover, the configuration of the terminal is based on that of the sixth embodiment in the description; however, this does not restrict the image processing system such that the advantage as the terminal can also be naturally obtained using a configuration based on the configuration of each of the first to fifth embodiments.

INDUSTRIAL APPLICABILITY

As described above, in accordance with the present invention, by dynamically changing the black reset period according to the amount of movement and the brightness feature, there can be provided a display device in which the mobile picture quality is improved while removing the problem of the black reset scheme, namely, while lowering the reduction in the brightness to a minimum value.

Moreover, in accordance with the present invention, by additionally conducting the gradation correction for the input image signal according to the amount of movement and the brightness feature, there can be provided a display device having improved mobile picture quality and displaying a clear image.

Furthermore, in accordance with the present invention, by dynamically changing the black reset period according to the amount of movement and the brightness feature, there can be provided an image display system in which the dynamic range is widened to improve the mobile picture quality of a hold type display device.

Moreover, in accordance with the present invention, by using the display device and the image display system, there can be provided a terminal device in which the dynamic range is enlarged to improve the mobile picture quality.

The invention claimed is:

1. A display device, characterized by comprising:

a display section including a display panel including a plurality of pixels arranged in a matrix form at intersections at which a plurality of scanning lines and a plurality of signal lines intersect each other, a scanning line driving circuit for conducting sequential driving control for the scanning lines, and a signal line driving circuit for conducting driving control for the signal lines according to an input video signal; and a lighting section disposed on a rear surface side of the display section, the lighting section including a plurality of lighting devices divided into subareas in a direction parallel to the scanning lines sequentially driven in the display section, a light driving section for controlling on and off of the lighting devices in an independent manner, a control signal generating section for sending a control signal to the light driving section according to an input video signal and a control signal, wherein said control signal generating section sets a ratio between an image gradation display period to conduct image display for the display and a black reset period to display black image therefor according to the amount of movement extracted from the input video signal and the video signal in the image memory, and an image memory for storing a video signal, the light driving section generating a control signal to control on and off timing of each of the lighting devices of the lighting section according to the input video signal, a video signal of a frame preceding a current frame and being stored in the image memory, and the control signal and sending the control signal to the light driving section.

2. The display device in accordance with claim 1, characterized by comprising a gradation correcting section for correcting gradation of the input video signal according to the control signal controlling the on and off timing of the lighting device, the video signal of which gradation is corrected by the gradation correcting section being supplied to the signal line driving circuit.

3. The display device in accordance with claim 1, characterized by comprising means for extracting a brightness feature from the input video signal, the control signal generating section setting the ratio between the image gradation display period to conduct image display for the display and the black reset period to display black image therefor according to the amount of movement extracted from the input video signal and the video signal in the image memory, and the brightness feature of the input video signal.

4. The display device in accordance with claim 1, characterized by comprising:

means for extracting a brightness feature from the input video signal; and means for extracting mean luminance from the input video signal, the control signal generating section setting the ratio between the image gradation display period to conduct image display for the display and the black reset period to display black image therefor according to the amount of movement extracted from the input video signal and the video signal in the image memory, the brightness feature of the input video signal, and the mean luminance thereof.

5. The display device in accordance with claim 1, characterized in that the control signal generator conducts control such that when writing starts in pixels corresponding to a scanning line at a first edge of a partition of the display section corresponding to one of the lighting devices, the lighting device is turned off and when a response of pixels corresponding to a scanning line at a last edge of the partition is finished, the lighting device is turned on.

6. A display device, characterized by comprising:

a display section including a display panel including a plurality of pixels arranged in a matrix form at intersections at which a plurality of scanning lines and a plurality of signal lines intersect each other, a scanning line driving circuit for conducting sequential driving control for the scanning lines, and a signal line driving circuit for conducting driving control for the signal lines according to an input video signal; and a lighting section disposed on a rear surface side of the display section, the lighting section including a plurality of lighting devices divided into subareas in a direction parallel to the scanning lines sequentially driven in the display section, a light driving section for controlling on and off of the lighting devices in an independent manner, a control signal generating section for sending a control signal to the light driving section, and a decoding circuit for decoding an encoded input video signal, the control signal generating section inputting movement vector information obtained by the decoding circuit, generating a control signal to control on and off timing of each of the lighting devices of the lighting section according to an amount of movement, and delivering the control signal thus generated to the light driving section, and the control signal generating section setting a ratio between an image gradation display period to conduct image display for the display and a black reset period to display black image therefor according to the input video signal and the amount of movement.

7. A display device, characterized by comprising:

a display section including a display panel including a plurality of pixels arranged in a matrix form at intersections at which a plurality of scanning lines and a plurality of signal lines intersect each other, a scanning line driving circuit for conducting sequential driving control for the scanning lines, and a signal line driving circuit for conducting driving control for the signal lines according to an input video signal;

a gradation correcting section for correcting gradation of the input video signal, the video signal of which gradation is corrected by the gradation correcting section being supplied to the signal line driving circuit, wherein the wherein the gradation correcting section corrects gradation of the input video signal according to an amount of movement of an image or according to mean luminance and an amount of movement of an image; and a lighting section disposed on a rear surface side of the display section, the display device further comprising:

an optical shutter in front of the lighting section and the display section or in front of the display section, the optical shutter being divided into a plurality of subareas in a scanning direction of the display section;

an optical shutter control section for controlling the optical shutter subareas in an independent fashion, the optical shutter conducting light interruption for a black reset period during one frame period and conducting light transmission during an image gradation display period;

a control signal generating section for sending a control signal to the optical shutter control section according to the input video signal and the control signal; and an image memory for storing a video signal, the control signal generating section generating a control signal to control transmitting and interrupting timing of the optical shutter according to the input video signal, a video signal of a frame preceding a current frame stored in the image frame, and a control signal inputted thereto, and outputting the control signal thus generated to the optical shutter control section.

8. A display device, characterized by comprising:

a display section including:

a display panel including a plurality of pixels arranged in a matrix form at intersections at which a plurality of scanning lines and a plurality of signal lines intersect each other, a scanning line driving circuit for conducting sequential driving control for the scanning lines, and a signal line driving circuit for conducting driving control for the signal lines according to an input video signal;

a gradation correcting section for correcting gradation of the input video signal, the video signal of which gradation is corrected by the gradation correcting section being supplied to the signal line driving circuit, wherein the wherein the gradation correcting section corrects gradation of the input video signal according to an amount of movement of an image or according to mean luminance and an amount of movement of an image; and a lighting section disposed on a rear surface side of the display section, the display device further comprising:

an image memory for storing a video signal; and a control signal generating section for generating a black reset period setting signal to control setting of a black period according to a video signal of a frame preceding a current frame stored in the image frame and a control signal and outputting the black reset period setting signal to the scanning line driving circuit, the lighting section being turned on fully at a time, an image gradation display pulse and a black reset display pulse being inputted to each of the scanning lines once during one frame period.

* * * * *